US008005380B2

(12) United States Patent
Kubo

(10) Patent No.: US 8,005,380 B2
(45) Date of Patent: Aug. 23, 2011

(54) IMAGE FORMING APPARATUS

(75) Inventor: Norihiko Kubo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 442 days.

(21) Appl. No.: 12/177,272

(22) Filed: Jul. 22, 2008

(65) Prior Publication Data

US 2009/0028591 A1 Jan. 29, 2009

(30) Foreign Application Priority Data

Jul. 26, 2007 (JP) ..... 2007-194714

(51) Int. Cl.
*G03G 15/02* (2006.01)

(52) U.S. Cl. ..... 399/50; 399/128

(58) Field of Classification Search ..... 399/50–52, 399/128, 168, 176
See application file for complete search history.

(56) References Cited

U.S. PATENT DOCUMENTS

| | | | | |
|---|---|---|---|---|
| 5,771,422 | A | 6/1998 | Morihara | |
| 7,620,339 | B2 | 11/2009 | Kubo | |
| 2003/0091358 | A1 * | 5/2003 | Komori | 399/50 |
| 2007/0047992 | A1 | 3/2007 | Kubo | |

FOREIGN PATENT DOCUMENTS

| | | | |
|---|---|---|---|
| CN | 1156270 A | | 8/1997 |
| CN | 1082681 A | | 4/2002 |
| CN | 1959564 A | | 5/2007 |
| JP | 05181350 A | * | 7/1993 |
| JP | 11-133825 A | | 5/1999 |
| JP | 2003-307979 A | | 10/2003 |

OTHER PUBLICATIONS

Notification of the First Office Action dated Jan. 22, 2010, in counterpart Chinese Application No. 200810133471.4.

* cited by examiner

*Primary Examiner* — David Gray
*Assistant Examiner* — Barnabas T Fekete
(74) *Attorney, Agent, or Firm* — Fitzpatrick, Cella, Harper & Scinto

(57) ABSTRACT

An image forming apparatus includes a photosensitive member; a charging device; an exposure device device; a developing device; a transfer charger; a pre-exposure device; a current detector; a calculating device; and a correcting device. The calculating device determines a property formula on the basis of currents, detected by the current detector, flowing between said transfer member, or the charging device, and an area of the photosensitive member charged by the light discharger. The calculating device calculates a correction amount of the correcting device on the basis of the property formula and a current flowing between said transfer member and an area of the photosensitive member charged by the charging device which is supplied with a predetermined DC voltage with discharging by the pre-exposure device.

6 Claims, 13 Drawing Sheets

IMAGE FORMING APPARATUS

FIELD OF THE INVENTION AND RELATED ART

The present invention relates to an image forming apparatus, in particular, a copying machine, a printer, a facsimile machine, or the like, which employs an electrophotographic image forming method.

A typical conventional electrophotographic image forming apparatus is structured to form an image on a recording medium through the following steps: First, a photosensitive member (negatively chargeable) is uniformly charged by a charging device, and an electrostatic image is formed on the surface of the photosensitive member by exposing the surface of the photosensitive member using an exposing device. Then, the electrostatic image on the photosensitive member is developed by the combination of a developing device and toner (negatively chargeable) into an image formed of toner. Then, the image formed of toner (which hereafter will be referred to simply as a toner image) is transferred onto recording medium by a transfer charging device.

A typical conventional electrophotographic image forming apparatus is also structured so that after the transfer of the toner image onto the recording medium, the photosensitive member is exposed (pre-exposed) with an optical charge removing device (pre-exposing apparatus) to erase an electrostatic memory remaining on the photosensitive member (for example, an image forming apparatus disclosed in Japanese Laid-open Patent Application 2003-307979).

However, illuminating (pre-exposing) a photosensitive drum with the use of a pre-exposing apparatus before charging the photosensitive drum causes the surface potential of the photosensitive member to significantly decay after the photosensitive member is charged. (When the photosensitive drum is not pre-exposed before being charged, the surface potential of photosensitive drum is unlikely to significantly decay). Thus, in the case of an electrophotographic image forming apparatus structured to pre-expose its photosensitive member before charging it, if a charge voltage is set to a value equal to a preset potential level to which a photosensitive member is to be charged, the photosensitive member is charged to a potential level which is significantly lower than the preset potential level. The cause of this phenomenon is thought to be as follows. That is, as a photosensitive member is illuminated with a pre-exposing apparatus, a positive charge is generated in the photosensitive member; photocarriers are generated in the photosensitive member. However, it is possible that as a photosensitive member is exposed to an amount of light which is necessary to satisfactorily erase the electrostatic memory of the photosensitive member, an excessive amount of photocarriers will be generated in the photosensitive member, cancelling a significant amount of charge applied by a charging member.

This phenomenon, that is, the phenomenon that a potential level of a photosensitive member is reduced after it is charged, is likely to be exacerbated by the deterioration of the photosensitive member attributable to the age of the photosensitive drum and/or cumulative usage of the photosensitive drum.

If a photosensitive member fails to be charged to a desired potential level, the subsequent image forming steps are affected. Thus, it has been proposed to provide an image forming apparatus with a potentiometer for detecting the potential level of the photosensitive member after the photosensitive member is charged by a charging device, and then, to adjust the settings of the charging device, based on the output of the potentiometer (Japanese Laid-open Patent Application H11-133825). Providing an image forming apparatus with a potentiometer to solve the above described problem requires providing space for the potentiometer, contradicting the effort to reduce the size of an image forming apparatus, and also, it increases the cost of an image forming apparatus.

Therefore, in the case of a conventional electrophotographic image forming apparatus which is not provided with a potentiometer, the potential level of the photosensitive drum is estimated by measuring the amount of the current which flows to a transfer charging device (transfer roller) while the portion of the peripheral surface of the photosensitive member, which has just been uniformly charged by a charging device after being illuminated with a pre-exposing apparatus, moves through the transferring portion. Then, the settings of the charging device are adjusted, based on the estimated surface potential level of the photosensitive drum.

However, the conventional method used for estimating the potential level of the photosensitive member of an electrophotographic image forming apparatus having no potentiometer cannot accurately estimate the potential level of the photosensitive member, for the following reason.

That is, the electrical resistance of a transfer roller is sometimes affected by changes in the ambient conditions, and/or deterioration of the photosensitive member, which occurs with the usage and aging of the photosensitive drum. Thus, the current value obtained with the use of the above-described conventional method reflects a change in the electrical resistance of the transfer charge roller.

SUMMARY OF THE INVENTION

Thus, a primary object of the present invention is to provide an electrophotographic image forming apparatus which can properly charge its photosensitive member regardless of the phenomenon that after the charging of the photosensitive member, the surface potential of the photosensitive member is affected by the process of erasing the electrostatic memory of the photosensitive member by exposing the photosensitive member using of a pre-exposing device before charging the photosensitive member.

According to an aspect of the present invention, there is provided an image forming apparatus comprising a photosensitive member; a charging device for charging the photosensitive member; an exposure device for exposing the photosensitive member charged by the charging device in accordance with image information; a developing device for developing, with toner, an electrostatic image formed on the photosensitive member by the exposure device into a toner image; a transfer charger for transferring the toner image formed on the photosensitive member by the developing device onto an image receiving member in a transfer portion; a light discharger, provided between the transfer charger and the charging device with respect to a rotational direction of the photosensitive member, for electrically discharging by light the photosensitive member; a current detector for detecting a current flowing through the transfer charger; a corrector for correcting a charging bias voltage applied to the charging device on the basis of an output of the current detector provided when a portion of the photosensitive member charged by the charging device substantially without being subjected to a light discharging operation of the light discharger passes through the transfer portion and on the basis of an output of the current detector provided when a portion of the photosensitive member subjected to a light discharging operation of the light discharger and charged by the charging device passes through the transfer portion.

According to another aspect of the present invention, there is provided an image forming apparatus comprising a photosensitive member; a charging device for charging the photosensitive member in a charging portion; an exposure device for exposing the photosensitive member charged by the charging device in accordance with image information; a developing device for developing, with toner, an electrostatic image formed on the photosensitive member by the exposure device into a toner image; a transfer charger for transferring the toner image formed on the photosensitive member by the developing device onto an image receiving member in a transfer portion; a light discharger, provided between the transfer charger and the charging device with respect to a rotational direction of the photosensitive member, for electrically discharging by light the photosensitive member; a current detector for detecting a current flowing through the charging device; a corrector for correcting a charging bias voltage applied to the charging device on the basis of an output of the current detector provided when a portion of the photosensitive member charged by the charging device substantially without being subjected to a light discharging operation of the light discharger passes through the charging portion and on the basis of an output of the current detector provided when a portion of the photosensitive member subjected to a light discharging operation of the light discharger and charged by the charging device passes through the charging portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the several embodiments of the present invention will be described in detail with reference to the appended drawings. Incidentally, it should be noted here that this application is intended to cover a part, parts, or the entirety of the modifications of the structure of the image forming apparatuses in the following embodiments of the present invention, which have been made within the scope of the concept of the present invention.

In other words, not only is the present invention applicable to an electrophotographic image forming apparatus which employs an intermediary transfer member as an image receiving member, but also, an electrophotographic image forming apparatus which directly transfers an image onto a recording medium as recording medium receiving member, and an image forming apparatus which employs a recording medium conveyance belt.

The following embodiments of the present invention will be described regarding only the portions of an electrophotographic image forming apparatus, which are involved in the formation and transfer of a toner image. However, the present invention is applicable to various electrophotographic image forming apparatuses, such as a printer, a facsimile machine, a multifunction image forming apparatus, or the like, which is made up of the portions similar to the portions involved in the formation and transfer of a toner image, and the other devices, apparatuses, frames, housings, etc., which are necessary to complete an electrophotographic image forming apparatus.

Embodiment 1

Figure 1:
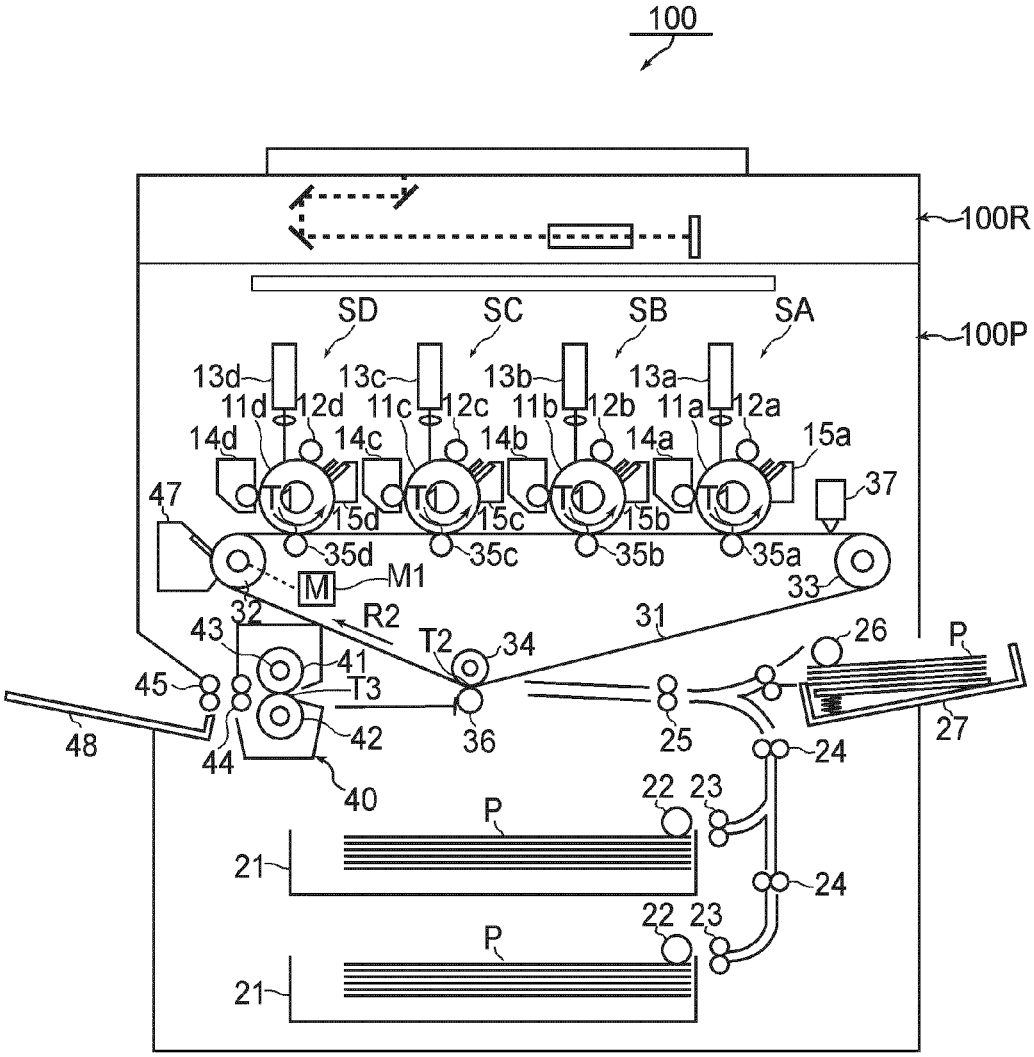
FIG. 1 is a schematic drawing showing the structure of the image forming apparatus according to a first embodiment of the present invention.
Figure 2:
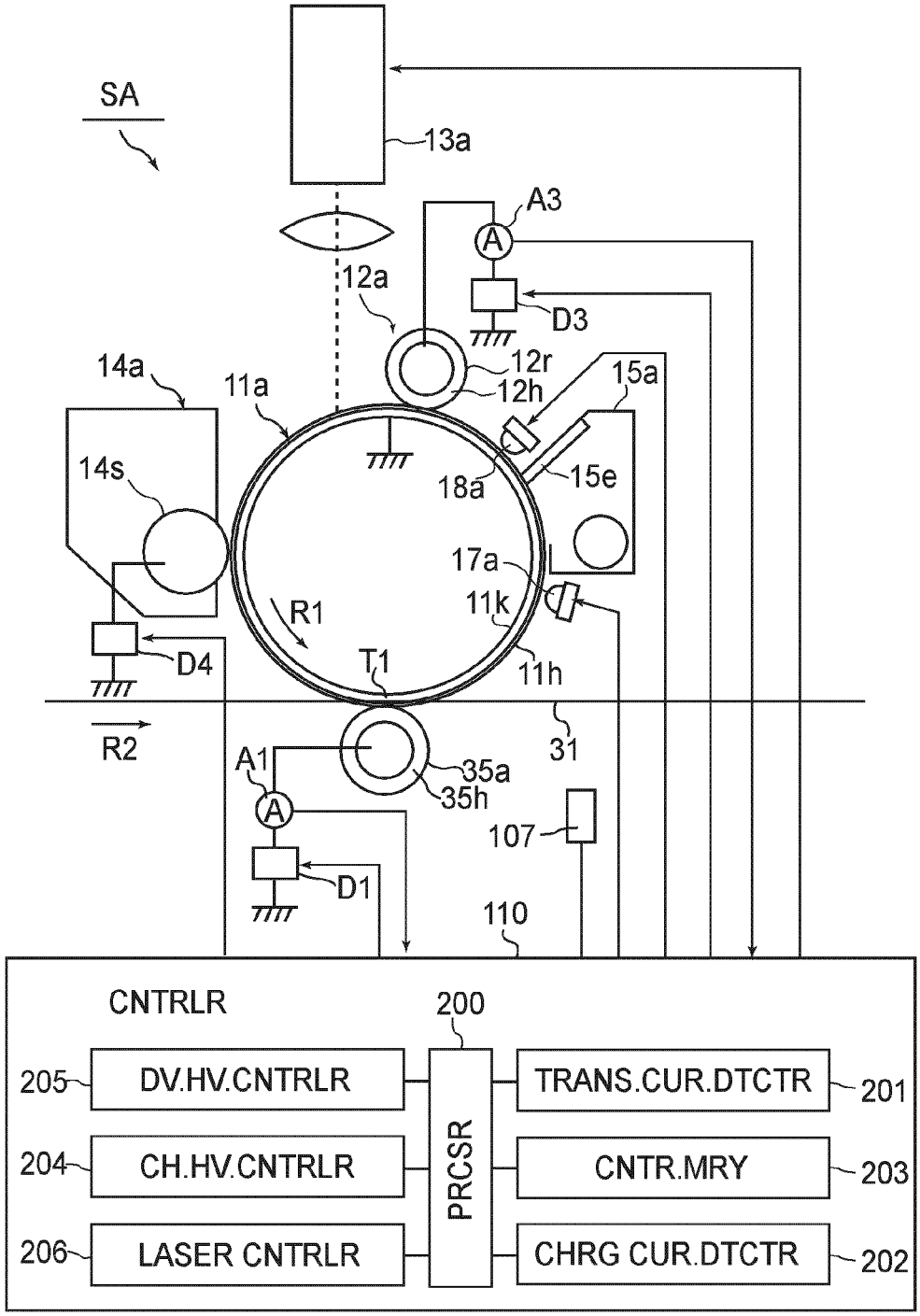
FIG. 2 is a schematic drawing showing in detail the photosensitive drum, and the processing means in the adjacencies of the photosensitive drum, regarding their structure.

FIG. 1 is a schematic drawing illustrating the structure of the image forming apparatus according to a first embodiment of the present invention. FIG. 2 is a schematic drawing illustrating the portions of the image forming apparatus, which are in the adjacencies of the photosensitive drum, regarding their structure.

Referring to FIG. 1, the image forming apparatus 100, according to the first embodiment of the present invention, is a full-color copying machine of a so-called tandem type, which has four image forming portions SA, SB, SC, and SD arranged in tandem in a straight line in an area which corresponds to the straight portion of the intermediary transfer belt 31 of the apparatus.

In the image forming portion SD, that is, the most upstream image forming portion, a yellow toner image is formed on a photosensitive member 11*d* (which hereafter will be referred to as photosensitive drum 11*d*), and is transferred (primary transfer) onto the intermediary transfer belt 31 as an image receiving member. In the image forming portion SC, a magenta toner image is formed on a photosensitive drum 11*c*, and is transferred (primary transfer) onto the intermediary transfer belt 31 in a manner to be layered on the yellow toner on the intermediary transfer belt 31. In the image forming portions SB and SA, a cyan toner image and a black toner image are formed on a photosensitive drum 11*b* and a photosensitive drum 11*a*, respectively, and are transferred (primary transfer) onto the intermediary transfer belt 31 in a manner similar to the manner in which the magenta toner image is transferred onto the intermediary transfer belt 31.

After being transferred (primary transfer) onto the intermediary transfer belt 31, the four toner images, different in color, are conveyed to the secondary transfer portion T2, in which they are transferred together (secondary transfer) onto a recording medium P. Recording mediums P are fed one by one into the image forming apparatus from a recording sheet feeder cassette 21 or a recording medium feeder tray 27. Then, each recording medium P is conveyed to the secondary transfer portion T2 by a pair of registration rollers 25.

After the toner images are transferred onto the recording medium P in the secondary transfer potion T2, the recording medium P is conveyed to the fixing apparatus 40, in which it is subjected to heat and pressure to fix the toner images to the surface of the recording medium P. After the fixation of the toner images, the recording medium P is conveyed further by a pair of inward discharge rollers 44, and then, is discharged into the delivery tray by a pair of outward discharge rollers 45.

As the recording mediums P are drawn out of the recording medium feeder cassette 21, which is capable of accommodating multiple recording media different in size, by a pickup roller 22, a separating apparatus 23 separates one by one the recording mediums P, and sends each recording medium P to the pair of registration rollers 25.

As the recording medium P reaches the registration rollers 25, the registration rollers 25 temporarily keep the recording medium P on standby, and then, release (pinch and convey) the recording medium P so that the recording medium P will reach the secondary transfer portion T2 at the same time as the toner images on the intermediary transfer belt 31 reach the secondary transfer portion T2.

The intermediary transfer belt 31, that is, a temporary holder of the toner images, is a 100 μm thick endless belt formed of polyimide resin. As the toner images are transferred (primary transfer) onto the intermediary transfer belt 31 in the primary transfer portions T1, the intermediary transfer belt 31 conveys the toner images to the secondary transfer portion T2 in which the toner images are transferred (secondary transfer) onto the recording medium P. The intermediary transfer belt 31 is 300 mm/sec in peripheral velocity and 330 mm in a dimension parallel with the axial line of the photosensitive drum 11*a*.

The intermediary transfer belt 31 is supported by a tension roller 33, a driver roller 32, and a backup roller 34, and rotates in the direction indicated by an arrow mark R2 at a preset process speed by being driven by a pulse motor M1.

The secondary transfer roller 36 is kept pressed against the backup roller 34 with the presence of the intermediary transfer belt 31 between the two rollers 36 and 34. It forms the secondary transfer portion T2 between the intermediary transfer belt 31 and itself.

In the secondary transfer portion T2, the recording medium P is conveyed, while remaining pinched between the secondary transfer roller 36 and intermediary transfer belt 31 so that the toner images on the intermediary transfer belt 31 align with the recording medium P. The negatively charged toner images on the intermediary transfer belt 31 are transferred (secondary transfer) onto the recording medium P, by applying a positive voltage to the secondary transfer roller 36 from an unshown electric power source.

The backup roller 34 is on the downstream side of the secondary transfer portion T2, and causes the recording medium P having adhered to the intermediary transfer belt 31, to separate from the intermediary transfer belt 31, by bending the portion of the intermediary transfer belt 31 so as to be curved, which is in the portion of the intermediary transfer belt loop, which corresponds in position to the backup roller 34, by its curvature.

The cleaning apparatus 47 prepares the portion of the intermediary transfer belt 31, which has just passed the secondary transfer portion T2, for the following primary transfer, by removing the transfer residual toner, that is, the toner remaining on the intermediary transfer belt 31 after the secondary transfer.

The fixing apparatus 40 is made up of a hollow heat roller 41 having a heating lamp 43 in the center of the hollow, and a pressure roller 42. The pressure roller 42 is kept pressed against the heat roller 41 by the resiliency of springs, forming the fixing portion T3.

The recording medium P having just received the toner images in the secondary transferring portion T2 is conveyed through the fixing portion T3 while remaining pinched by the heat roller 41 and pressure roller 42, being therefore subjected to the heat and pressure from the two rollers 41 and 42. Thus, the toner images on the recording medium P become fixed to the surface of the recording medium P while the recording medium P is conveyed through the fixing portion T3.

The image forming portions SA, SB, SC, and SD are the same in structure, although they are different in the color (black, cyan, magenta, or yellow) of the toner in their developing devices 14*a*, 14*b*, 14*c*, and 14*d*, respectively, (which hereafter will be referred to as developing apparatus 14*a*, 14*b*, 14*c*, and 14*d*). Thus, in the following sections of this specification of the present invention, only the image forming portion SA will be described, because the image forming portion SB, SC, and SD are the same in structure as the image forming portion SA except for the referential designations a, b, c, and d, and therefore, the description of the structure and function of the image forming portions SB, SC, and SD can be provided simply by substituting referential designations b, c, or d for the referential designation a in the following description of the image forming portion SA.

Referring to FIG. 2, the image forming portion SA has a photosensitive drum 11*a*, and multiple photosensitive drum processing means, more specifically, a charging device 12*a* (which hereafter will be referred to as primary charging apparatus), an exposing device 13*a* (which hereafter will be referred to as exposing apparatus), a developing device 14*a* (which hereafter will be referred to as developing apparatus), a transfer charging device 35*a* (which hereafter will be referred to as primary transfer roller), and a cleaning apparatus 15*a*. The multiple processing means are positioned in the adjacencies of the peripheral surface of the photosensitive drum 11*a* in a manner to surround the peripheral surface of the photosensitive drum 11*a*.

The photosensitive drum 11*a* is made up of an aluminum cylinder 11*k* (30 mm in diameter), and a negatively chargeable photosensitive layer 11*h*. The aluminum cylinder 11*k* is grounded. The photosensitive layer 11*h* is on the peripheral surface of the aluminum cylinder 11*k*, and covers the entirety of the peripheral surface of the aluminum cylinder 11*k*. The photosensitive drum 11*a* is rotatably supported at its lengthwise end portions by a pair of flanges, one for one. To one of the lengthwise ends of the photosensitive drum 11*a*, rotational driving force is transmitted from an unshown motor to rotate the photosensitive drum 11*a* at a preset process speed in the direction indicated by a directional arrow R1.

The primary charging apparatus 12*a* uniformly charges the peripheral surface of the photosensitive drum 11*a* to a preset potential level with the use of a charge roller 12*r* which is kept pressed upon the peripheral surface of the photosensitive drum 11*a* and is rotated by the rotation of the photosensitive drum 11*a*. The primary charging apparatus 12*a*, that is, the charging means in this embodiment, is a charging apparatus of a so-called contact type. Therefore, the photosensitive drum 11*a* is uniformly charged to the potential level which is equal to the potential level of the voltage applied to the charging means.

The electric power source D3 charges the peripheral surface of the photosensitive drum 11*a* to the negative polarity by applying the combination of DC and AC voltages to the charge roller 12*r*. The charge voltage, that is, the voltage to be applied to the primary charging apparatus 12*a* which is the charging means in this embodiment, is the combination of DC and AC voltages. Therefore, the photosensitive drum 11*a* is uniformly charged to the potential level which is the same as the potential level of the charge voltage applied to the charging means.

A current detection circuit A3 outputs to a control portion, an analog voltage, the potential level of which is equivalent to the amount by which electrical current flows into the charge roller 12*r* from the electric power source D3.

The surface layer 12*h* of the charge roller 12*r* is 1-2 mm thick, and is formed of an electrically conductive rubber, the electrical resistance of which has been adjusted to a value in a range of 105-107Ω.cm by dispersing an electrically conductive substance, such as carbon black, in the rubber. The charge roller 12*r* is kept pressed upon the photosensitive drum 11*a* without a gap between the charge roller 12*r* and photosensitive drum 11*a*, by utilizing the elasticity of the surface layer 12*h*. Therefore, it is unlikely that the peripheral surface of the photosensitive drum 11*a* becomes nonuniformly charged by the charge roller 12*r*.

The exposing apparatus 13*a* writes the electrostatic image of an intended image, on the charged portion of the peripheral surface of the photosensitive drum 11*a*, by deflecting a laser light beam which it projects, while modulating (turning on or off) the light beam with the pictorial data obtained by developing the electrical signals corresponding to the black component of the optical image of the intended image, that is, one of the color components into which the optical image is separated.

The developing apparatus 14*a* develops in reverse the electrostatic image on the peripheral surface of the photosensitive drum 11*a*, by supplying the peripheral surface of the photosensitive drum 11*a* with the negatively charged toner so that the toner adheres to the numerous exposed points of the electrostatic image. The developing apparatus 14*a* rotates its development sleeve 14*s*, on which a thin layer of toner is borne, in a direction counter to a rotational direction of the photosensitive drum 11*a*.

The electric power source D4 transfers the toner on the development sleeve 14*s*, onto the electrostatic image on the peripheral surface of the photosensitive drum 11*a*, by applying the combination of the negative DC voltage and AC voltage to the development sleeve 14*s*.

The primary transfer roller 35*a* is kept pressed against the peripheral surface of the photosensitive drum 11*a* with the presence of the intermediary transfer belt 31 between the primary transfer roller 35*a* and photosensitive drum 11*a*, forming the primary transferring portion T1 between the photosensitive drum 11*a* and intermediary transfer belt 31. The primary transfer roller 35*a* presses the intermediary transfer belt 31 upon the toner image, which is being moved through the primary transferring portion T1.

The primary transfer roller 35*a* is made up of a metallic core and a surface layer 35*h*. The metallic core is 8 mm in diameter. The surface layer 35*h* is formed of urethane sponge, the electrical resistance of which has been adjusted to $5\times10^7\Omega$ by dispersing electrically conductive substance, such as an ion-conductive substance, in the urethane. The primary transfer roller 35*a* is 16 mm in external diameter.

An electric power source D1 transfers (primary transfer) the negatively charged toner image on the photosensitive drum 11*a* onto the intermediary transfer belt 31 by applying positive DC voltage to the primary transfer roller 35*a*.

A current detecting device A1 (which hereafter will be referred to as current detection circuit) outputs to the control portion (charge voltage control portion 204), an analog voltage, the potential level of which is equivalent to the amount by which electrical current flows into the primary transfer roller 35*a* from the electric power source D1.

In the first embodiment, as soon as the image forming apparatus is started up, three constant voltages which are different in potential while being constant in potential level, and the potential level of which is in a range which includes the preceding constant voltage, are outputted from the electric power source D1 to the primary transfer roller 35*a*, and the amount of the transfer current caused to flow by each of the three constant voltages is measured by the current detection circuit A1. Then, the relationship between the potential level of each constant voltage applied to the primary transfer roller 35*a* and the amount of the current which caused to flow by the applied voltage is obtained. From the thus obtained three relationships, the relationship between the potential level of the transfer voltage and the amount of the transfer current is obtained by interpolation. Then, based on this relationship between the potential level of the transfer voltage and the amount of the transfer current, a value for the potential level of the constant voltage, which causes 40 μA of electric current to flow through the current detection circuit A1 is obtained. Then, a constant voltage (transfer voltage), the potential level of which equals the above-mentioned value, is applied to the primary transfer roller 35*a* during the subsequent image forming operation.

The cleaning apparatus 15*a* removes the transfer residual toner, that is, the toner remaining on the portion of the peripheral surface of the photosensitive drum 11*a*, which has just come through the primary transfer portion T1, to prepare the portion for the following toner image formation. The cleaning apparatus 15*a* is of a so-called counter blade type. That is, the cleaning blade 15*e* of the cleaning apparatus 15*a* is positioned so that the functional edge of the blade 15*e* remains in contact with the peripheral surface of the photosensitive drum 11*a* at an angle such that the functional edge of the blade 15*e* is on the upstream side of the base portion of the blade 15*e* in terms of the rotational direction of the photosensitive drum 11*a*. The cleaning blade 15*e* is 3 mm thick, and is formed primarily of urethane. It is 8 mm in the length of the functional edge. It is kept pressed upon the peripheral surface of the photosensitive drum 11*a* so that a linear contact pressure of roughly 35 g/cm is maintained between its functional edge and the peripheral surface of the photosensitive drum 11*a*.

On the upstream side of the cleaning apparatus 15*a*, in terms of the rotational direction of the photosensitive drum 11*a*, a charge removing optical device 17*a* (which hereafter will be referred to as pre-exposing apparatus 17*a*) is located, whereas on the downstream side of the cleaning apparatus 15*a*, another charge removing optical device 18*a* (which hereafter will be referred to as pre-exposing apparatus 18*a*) is located.

The pre-exposing apparatuses 17*a* and 18*a* are made up of light emitting members, which are in the form of a piece of rod; they are made up of multiple light sources (LEDs) arrayed in a direction parallel with the axial line of the photosensitive drum 11*a*. The light sources of the pre-exposing apparatuses 17*a* and 18*a* are 400-800 nm in their peak wavelength. The amount of light they emit can be adjusted in a range of 0.1 Lux.sec-50 Lux.sec, in terms of the amount measured at the peripheral surface of the photosensitive drum 11*a*. When the voltage applied to the light sources is off, the amount of the light from the light sources, which is measured at the peripheral surface of the photosensitive drum 11*a* is 0 Lux.sec.

The pre-exposing apparatus 17*a* uniformly exposes the entire portion of the peripheral surface of the photosensitive drum 11*a*, which has just come out of the primary transfer portion T1, with the transfer residual toner remaining thereon. As the above-mentioned portion of the peripheral surface of the photosensitive drum 11*a* is exposed, charge carriers are generated in the photosensitive layer of the portion of the photosensitive drum 11*a*, across which the transfer residual toner is not present, removing the surface potential from the portion of the peripheral of the photosensitive drum 11*a*, across which the transfer residual toner is not present. As a result, the areas of the portion of the peripheral surface of the photosensitive drum 11*a*, across which the toner is not present, becomes free of electrical charge.

The pre-exposing apparatus 18*a* uniformly exposes the entire portion of the peripheral surface of the photosensitive drum 11*a*, which has just passed by the cleaning apparatus 15*a*, that is, the portion of the peripheral surface of the photosensitive drum 11*a*, from which the transfer residual toner has just been completely removed by the cleaning apparatus 15*a*. As the above-mentioned portion of the peripheral surface of the photosensitive drum 11*a* is exposed, charge carriers are generated in the photosensitive layer of the photosensitive drum 11*a*, removing the potential from the peripheral surface of the photosensitive drum 11*a*, across which the transfer residual toner was present. As a result, the areas of the portion of the peripheral surface of the photosensitive drum 11*a*, across which the toner was present, also becomes free of electrical charge.

The control portion 110 is provided with an unshown control chip and an unshown motor driver chip, which control the operation of each unit.

The development high voltage control portion 205 controls an electric power source D4 to set the value for the DC component (development voltage Vdc) of the voltage to be applied to the development sleeve 14*s*.

The high charge voltage control portion 204, which functions as a charge voltage adjusting device, controls the electric power source D3 to set a value for the DC component (charge voltage Vd) of the voltage to be applied to the charge roller 12*r*.

A laser power control portion 206 controls the exposing apparatus 13*a* to set a value for the intensity of the laser beam emitted the exposing apparatus 13*a* to write an electrostatic image on the peripheral surface of the photosensitive drum 11*a*.

A charge current amount measuring portion 202 measures the amount of electric current which flows into the charge roller 12*r* from the electric power source D3, in order to determine the amount of the electric current which flows through the area of contact between the charge roller 12*r* and photosensitive drum 11*a*.

A temperature-humidity sensor 107 detects the ambient temperature and humidity. It is located in the main assembly 100 of the image forming apparatus, in an area where it is not affected by the fixing apparatus 40.

The control portion 110 calculates the amount of absolute humidity (g/kgair) based on the output of the temperature-humidity sensor 107, and continuously adjusts the image forming apparatus in image formation settings, based on the calculated amount of absolute humidity.

<Surface Potential Decay Attributable to Pre-Exposure>

Figure 3:
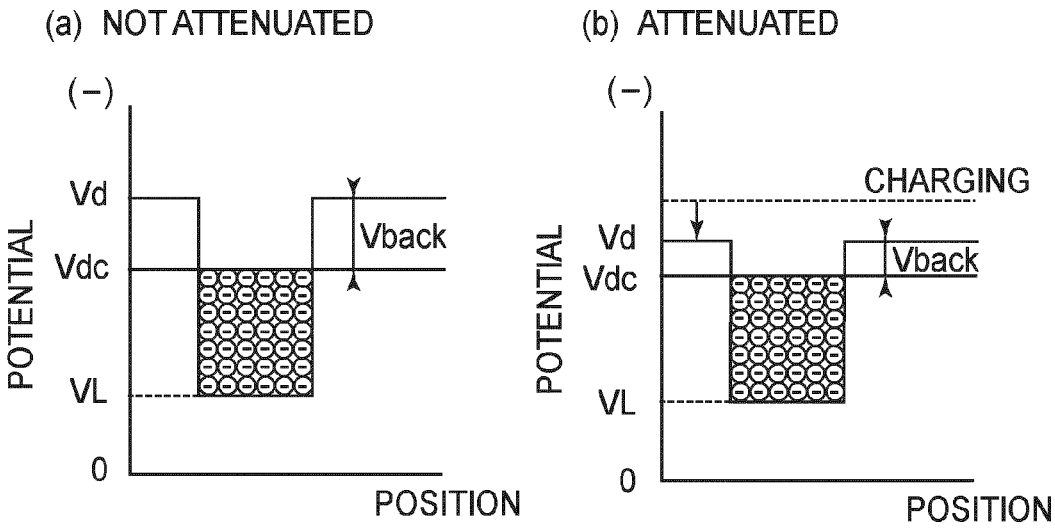
FIG. 3 is a schematic drawing showing the conditions under which a toner image is formed.
Figure 4:
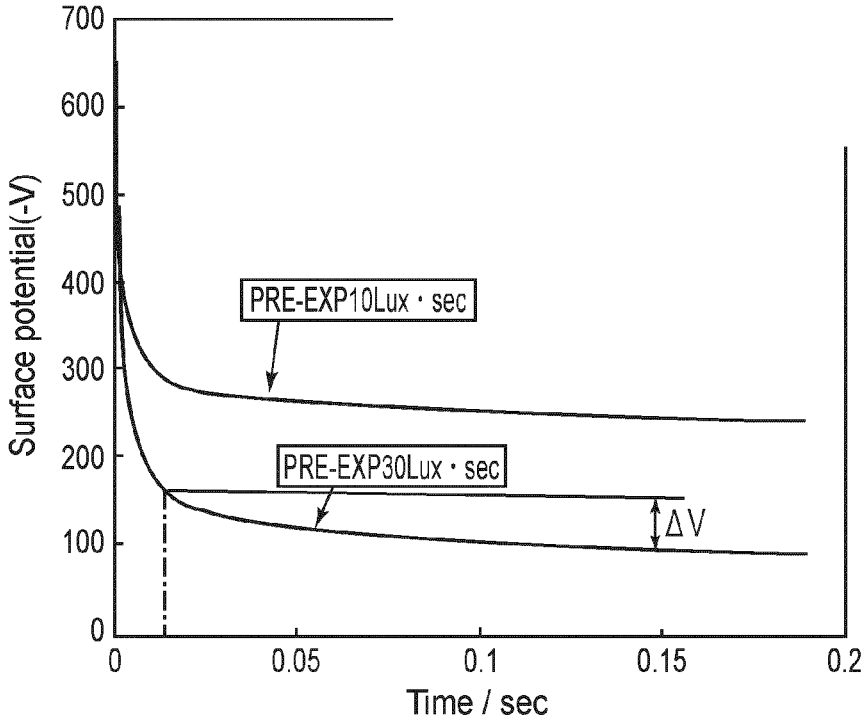
FIG. 4 is a graph showing the decay of the surface potential of the photosensitive drum, which is attributable to the pre-exposure of the photosensitive drum.

FIGS. 3(*a*) and 3(*b*) are schematic drawings showing the state of the peripheral surface of the photosensitive drum, in terms of surface potential, and FIG. 4 is a graph showing the decay of the surface potential of the photosensitive drum, which is attributable to the pre-exposure of the photosensitive drum. FIG. 3(*a*) shows the surface charge of the photosensitive drum 11*a*, which has not decayed, and FIG. 3(*b*) shows the surface charge of the photosensitive drum 11*a*, which has somewhat decayed.

Referring to FIG. 2, the photosensitive drum 11*a* is rotated in the direction indicated by directional arrow R1 at a process speed of 300 mm/sec. As it is rotated, it is rectified in the nonuniformity in electrical potential by the pre-exposing apparatuses 17*a* and 18*a*, and then, is uniformly charged to a preset potential level (which hereafter will be referred to as dark potential level Vd) by the primary charging apparatus 12*a*. The dark potential level Vd in this embodiment is set to −800 V (FIG. 3(*a*)).

As a given area of the peripheral surface of the photosensitive drum 11*a* is exposed by the exposing apparatus 13*a*, charge carriers are generated in the photosensitive layer of this area by the exposure. As a result, the potential level of the exposed points of this area is reduced to a potential level VL (which hereafter will be referred to as light potential level VL). The light potential level VL in this embodiment is −200 V.

The developing apparatus 14*a* develops the electrostatic image on the peripheral surface of the photosensitive drum 11*a* into a toner image, that is, an image formed of toner, by applying a development voltage Vdc to the development sleeve 14*s*. That is, as the development voltage Vdc is applied to the development sleeve 14*s*, the negatively charged toner borne on the peripheral surface of the development sleeve 14*s* adheres to the points of the peripheral surface of the photosensitive drum 11*a*, the potential of which has been reduced to the light potential level VL, which is on the positive side relative to the development voltage Vdc. The amount by which the negatively charged toner adheres to the points of the peripheral surface of the photosensitive drum 11*a*, the potential level of which is equal to the light potential level VL, is equal to the amount of the negatively charged toner necessary to cancel the difference between the light potential level VL and development voltage level Vdc.

In this first embodiment, the development voltage level Vdc is −650 V, and the amount of charge which the negatively charged toner has is 30 μC/g. Further, in order to prevent the formation of a foggy image, 150 V of difference Vback is provided between the dark potential level Vd and development voltage level Vdc, preventing the toner from adhering to the points of the electrostatic image on the peripheral surface of the photosensitive drum 11*a*, the potential level of which equals the dark potential level Vd.

However, if the amount of time which elapses between when electric charge is removed from a given area of the peripheral surface of the photosensitive drum 11*a* by the pre-exposing apparatus 18*a* and when the same area of the peripheral surface of the photosensitive drum 11*a* is charged by the primary charging apparatus 12*a* is insufficient, the electric charge (surface potential) of this area of the peripheral surface of the photosensitive drum 11*a* decays after the area passes by the primary charging apparatus 12*a*. That is, in a case where a given area of the peripheral surface of the photosensitive drum 11*a*, in the photosensitive layer of which charge carriers have been generated by the pre-exposing apparatus 18*a* to make the area uniform in surface potential level, is charged by the primary charging apparatus 12*a* while the charge carriers are remaining in the photosensitive layer, the remaining charge carriers cancel the electric charge given by the primary charging apparatus 12*a*, after the area passes by the primary charging apparatus 12*a*. In other words, in this case, the given area of the peripheral surface of the photosensitive drum 11*a* is charged by the primary charging apparatus 12*a*, in the state in which it has reduced in apparent volume resistivity through the pre-exposure. Thus, as soon as it is charged, it reduces in potential level at a speed incomparable to the speed of the ordinary dark decay.

FIG. 4 shows a process in which the electric charge of a given area of the peripheral surface of the photosensitive drum 11*a*, which has been charged to 700 V, reduces during the elapse of 0.2 second after the area passes by the pre-exposing apparatus 18*a*. The higher the pre-exposing apparatus 18*a* in exposure light intensity, the greater the charge carriers in the amount by which they are generated, and also, in average life, being therefore greater in the effects they have upon the electric charge of the area. For example, if a given area of the peripheral surface of the photosensitive drum 11*a* passes by the primary charging apparatus 12*a*, 0.015 second after it is exposed by the pre-exposing apparatus 18*a*, the exposure light intensity of which is 30 Lux.sec, the surface potential of area is estimated to be reduced by roughly 50V after it passes by the primary charging apparatus 12*a*.

Referring to FIGS. 2 and 3(*b*), as a given area of the peripheral surface of the photosensitive drum 11*a* reduces in surface potential level by 50 V after it passes by the primary charging apparatus 12*a*, the difference Vback between the dark potential level Vd and development voltage level Vdc reduces from 150 V to 100 V, making it more liable for a foggy image to be formed.

In this embodiment, therefore, the amount by which a charged area of the peripheral surface of the photosensitive drum 11*a* is reduced in potential level due to pre-exposure is estimated before the starting of an image forming operation. Then, the charge voltage level Vd of the primary charging apparatus 12*a* is increased by the amount proportional to the measured amount of reduction (decay) in potential level. That is, based on the presumption that the charge carriers generated in a given area of the peripheral surface of the photosensitive drum 11*a* by the pre-exposure will remain in the photosensitive layer of the area even after the area passes by the primary charging apparatus 12*a*, the charge voltage Vd applied to the charge roller 12*r* is raised to a value higher than 800 V.

A counter-memory 203 counts and stores the cumulative number of copies outputted after the most recent adjustment of the image formation setting of the image forming apparatus.

Each time the number outputted by the counter-memory 203 reaches 500, the control portion 110, which functions as a compensator or setting adjuster, interrupts the image forming operation, and resets the potential level of the charge voltage Vd, that is, the voltage applied to the primary charging apparatus 12*a*.

The transfer current amount measuring portion 201 determines the amount of the transfer current which flows through the transfer portion, which includes the area of contact between the intermediary transfer belt 31 and photosensitive drum 11*a*, by detecting, with the use of the electric current detection circuit A1, the amount of electric current which flows into the primary transfer roller 35*a* from the electric power source D1, through the intermediary transfer belt 31.

Based on the amount of the transfer current determined by the transfer current amount measuring portion 201 while no image is formed, the control portion 110 calculates the amount of the decay ΔV of the surface potential of the photosensitive drum 11*a*, which is attributable to the pre-exposure by the pre-exposing apparatuses 17*a* and 18*a*. Then, it increases the charge voltage Vd by an amount proportional to the amount of the decay ΔV.

In the first embodiment, the surface potential level of the photosensitive drum 11*a* is detected with the use of a high precision current detection system (current detection circuit A1 and transfer current amount measuring portion 201), which is provided to set a value for the constant voltage used for the primary transfer of a toner image.

Therefore, the surface potential level of the photosensitive drum 11*a* can be detected without providing the image forming apparatus with a sensor or detection circuit dedicated to the detection of the surface potential level of the photosensitive drum 11*a*.

The control portion 110 controls the exposure settings of the pre-exposing apparatuses. More specifically, it controls the pre-exposing apparatuses 17*a* and 18*a* so that the exposure lights emitted from the pre-exposing apparatus 17*a* and 18*a* are virtually zero (first pre-exposure light intensity) in terms of intensity, or keeps the pre-exposing apparatuses 17*a* and 18*a* turned off. Then, it charges the photosensitive drum 11*a* by the primary charging apparatus 12*a* under the preset conditions, and measures the level of the surface potential of the charged photosensitive drum 11*a* in Step 1. Incidentally, the level of the charge voltage applied in Step 1 is preferred to be the same as the level of the charge voltage applied for normal image formation. In this embodiment, the level of the charge voltage applied for normal image formation is −800 V.

Next, the control portion 110 performs Step 2, in which it sets the pre-exposing apparatuses to pre-expose the photosensitive drum 11*a*. More specifically, the control portion 110 sets the pre-exposing apparatuses 17*a* and 18*a* so that the intensity (second pre-exposure light intensity) of the pre-exposure light emitted by the pre-exposing apparatuses 17*a* and 18*a* is roughly the same as the intensity of the exposure light emitted for image formation by the exposing apparatus 13*a*. Thereafter, it makes the primary charging apparatus 12*a* charge the photosensitive drum 11*a*, and measures the level of the surface potential of the charged photosensitive drum 11*a*, in Step 2.

Based on the values obtained in Steps 1 and 2, the control portion 110 determines the amount of the dark decay, which is attributable to the pre-exposure. Then, it adjusts the image forming apparatus in image formation settings (setting of charging device) in order to compensate for the estimated amount of the dark decay.

In this embodiment, the level of the surface potential of the photosensitive drum 11*a* when there is no dark decay attributable to the pre-exposure, is estimated based on the level of the surface potential of the photosensitive drum 11*a*, which is obtained in Step 1 (first result of detection). Then, the level at which the surface potential of the photosensitive drum 11*a* will be after the pre-exposure is estimated based on the amount of current (second result of detection) measured in Step 2. Then, the difference between the first result of detection and second result of detection is obtained as the estimated amount of dark decay attributable to the pre-exposure. Then, the control portion 110 adjusts the charge voltage based on the thus obtained estimated amount of dark decay. With the employment of the above-described method for adjusting the charge voltage, the charged voltage is adjusted in a manner to compensate for the amount of the dark decay attributable to the pre-exposure. Therefore, it is possible to prevent the formation of a foggy image, which is attributable to the deviation of the difference Vback between the dark potential level Vd and development voltage level Vdc.

The current detection circuit A1 and transfer current amount measuring portion 201, which also function as a current detecting device, detect the amount of current which flows through the primary transfer roller 35*a* when voltage is applied to the primary transfer roller 35*a*.

Incidentally, hereafter, the control sequence for resetting an image forming portion in charge voltage level will be described, with reference to the case in which the charge voltage of the image forming portion SA is reset. However, the charge voltage level of the image forming portions SB, SC, and SD are also reset at the same time as the charge voltage level of the image forming portion SA is reset. In other words, the control sequence for resetting the charge voltage level of the image forming portions SB, SC, and SD is the same as that for resetting the charge voltage level of the image forming portion SA. Therefore, the description of the control sequence for resetting the charge voltage level of the image forming portion SB, SC, or SD can be provided simply substituting referential designations b, c, or d for the referential designation a in the following description of the charge voltage level of the image forming portion SA.

<Control Sequence for Resetting Charge Voltage>

Figure 5:
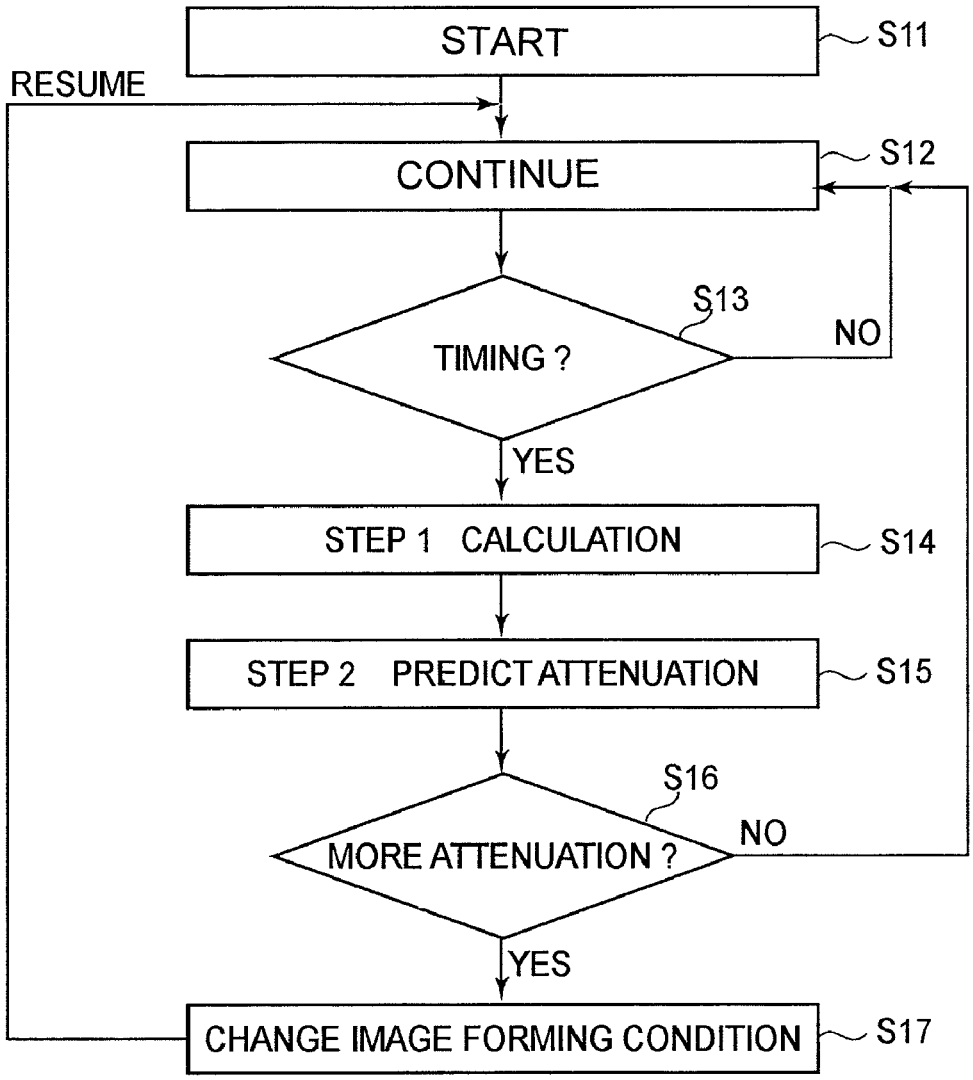
FIG. 5 is a flowchart of the operation for resetting a charge voltage in the first embodiment.
Figure 6:
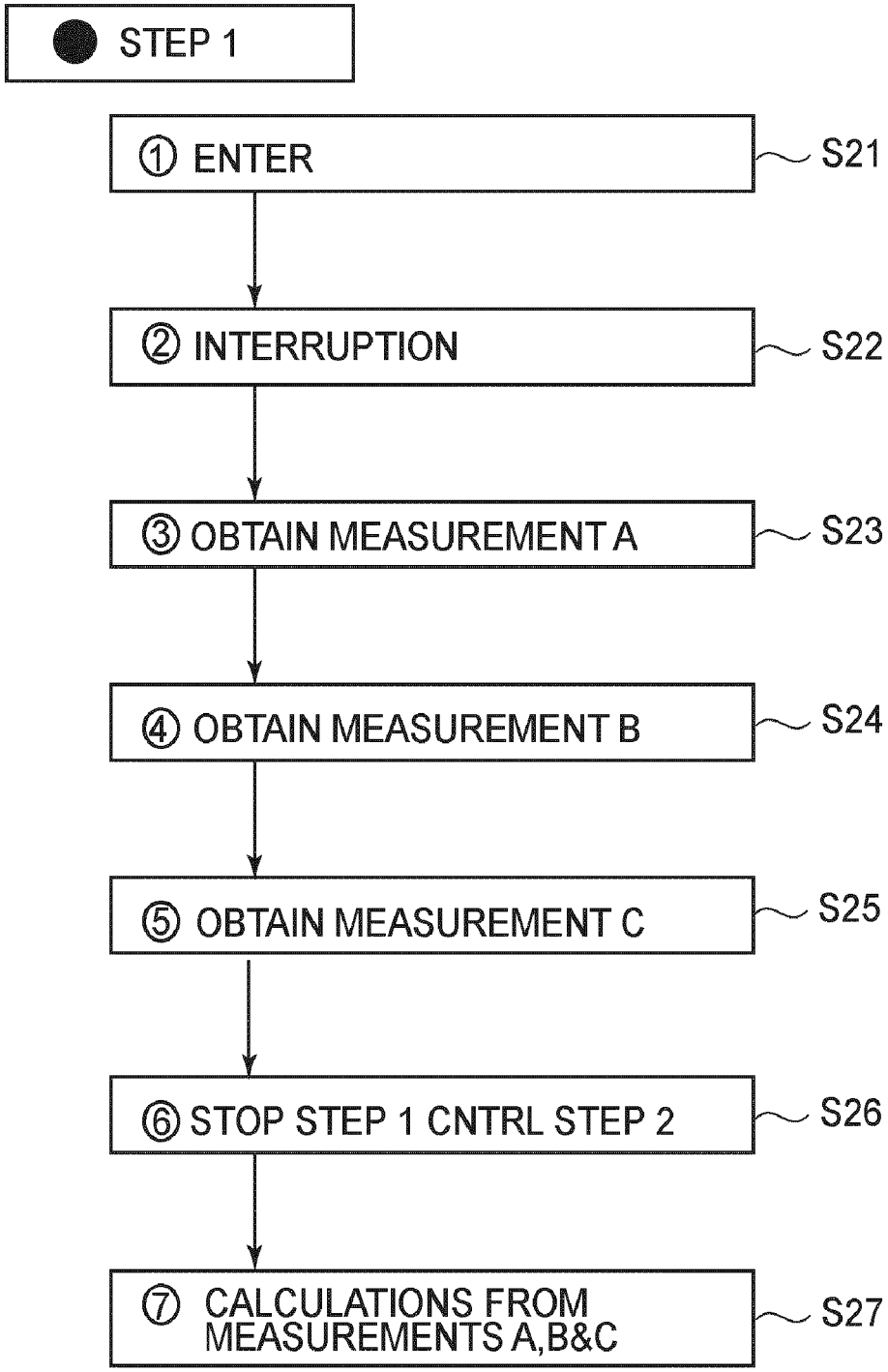
FIG. 6 is a flowchart of Step 1 of the charge voltage resetting operation in the first embodiment.
Figure 7:
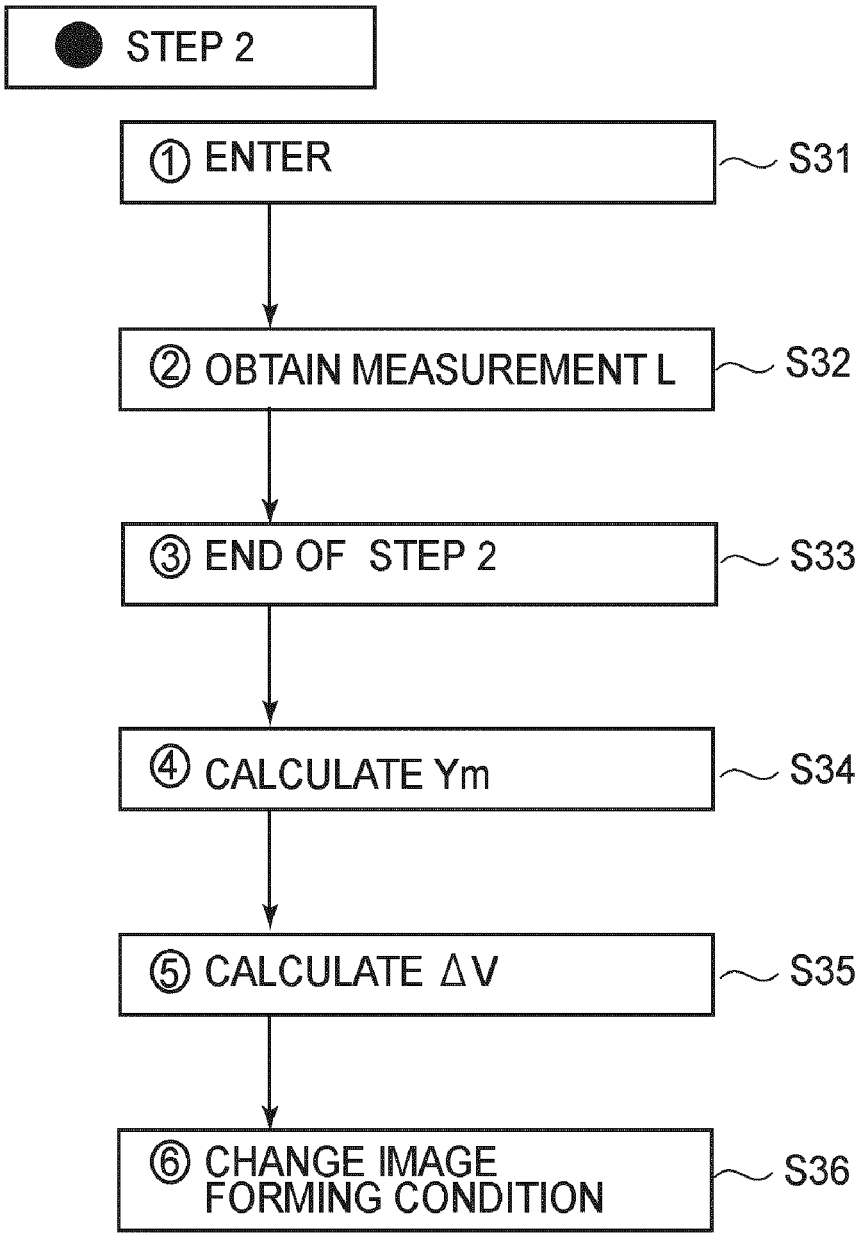
FIG. 7 is a flowchart of Step 2 of the charge voltage resetting operation in the first embodiment.
Figure 8:
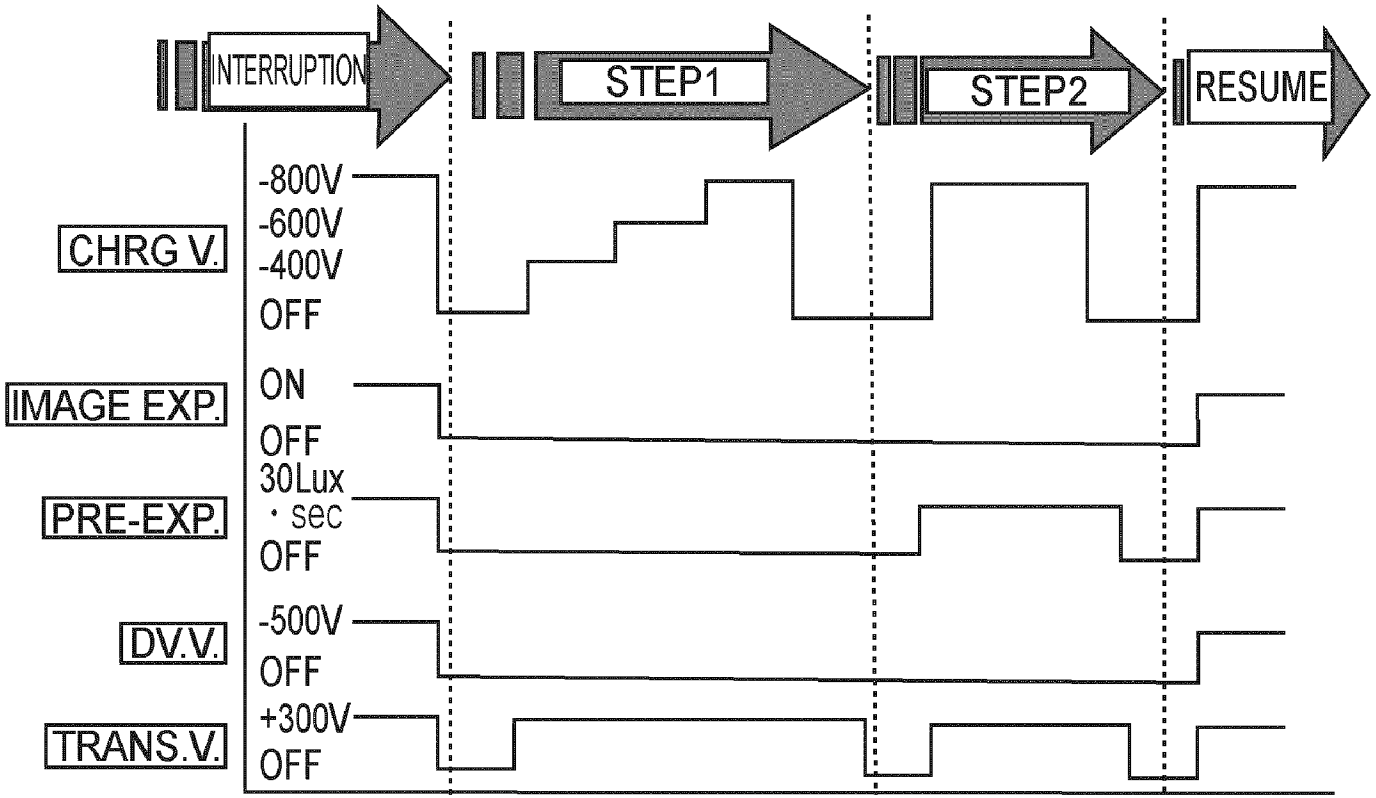
FIG. 8 is a timing chart of the charge voltage resetting operation in the first embodiment.
Figure 9:
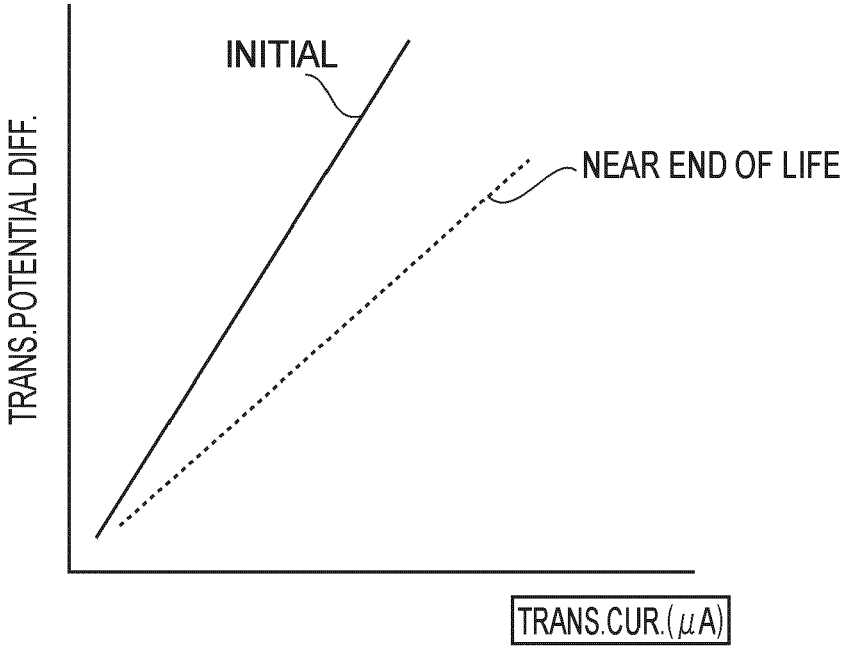
FIG. 9 is a graph showing the relationship between the amount of the transfer bias and the amount of transfer current, obtained in Step 1 in the first embodiment.

FIG. 5 is a flowchart of the control sequence for resetting a charge voltage level of an image forming portion, and FIG. 6 is a detailed flowchart of Step 1 in the control sequence for resetting a charge voltage level of an image forming portion. FIG. 7 is a flowchart of Step 2 in the control sequence for resetting a charge voltage level of an image forming portion. FIG. 8 is a timing chart for the control sequence for resetting a charge voltage level of an image forming portion. FIG. 9 is a graph showing the relationship between the amount of the transfer bias and the amount of transfer current, obtained in Step 1.

Referring to FIGS. 2 and 5, as a copying operation is started (S11), the control portion 110 continues the copying operation (S12) until the copy count accumulated in the counter-memory 203 reaches 500 (No in S13).

As the copy count in the counter-memory 203 reaches 500 (Yes in S13), the control portion 110 carries out a control sequence Step 1 (which hereafter will be referred to simply as Step 1) (S14).

Referring to FIG. 6, in Step 1, the control portion 110 varies a potential level of the DC voltage applied to the charge roller 12*r*, in multiple steps, with the pre-exposing apparatuses turned off, and detects the amount of transfer current which flows through the primary transfer portion T1, at each potential level of the DC voltage applied to the charge roller 12*r*. Then, it calculates the difference between the amount of the transfer current which flowed through the primary transfer portion T1, and the amount of transfer bias (difference in potential level between charge voltage and transfer voltage, or different in potential level between surface potential of photosensitive drum and transfer voltage), at each potential level of the DC voltage applied to the charge roller 12*r*. That is, it calculates the relationship between the amount of the transfer current and the amount of the transfer bias, where there is no surface potential decay attributable to the pre-exposure.

After the completion of Step 1, the control portion 110 carries out a control Step 2 (which hereafter may be referred to simply as Step 2) (S15).

In Step 2, as will be described later with reference to FIG. 7, the control portion 110 detects the amount of the transfer current which flows through the primary transferring portion T1, while applying to the charge roller 12*r*, a charge voltage which is the same in potential level as the charge voltage applied to the charge roller 12*r* during an image forming operation, and also, keeping the pre-exposing apparatuses 17*a* and 18*a* turned on, with the amount of their exposure light set to the same value as that to which the amount of the exposure light is set during an image forming operation. Then, the control portion 110 estimates the amount of the surface potential decay ΔV attributable to the pre-exposure which is the same in amount as that of the exposure during an image forming operation, based on the relationship between the amount of the transfer current and the amount of the transfer bias, where there is no surface potential decay attributable to the pre-exposure.

If the presence of the surface potential decay ΔV attributable to the pre-exposure step carried out before the charging of the photosensitive drum 11*a* is not confirmed in Step 2 (No in S16), the control portion 110 continues the copying operation without resetting the toner image formation conditions (without adjusting charging apparatus in potential level setting) (S12). On the other hand, if the presence of the surface potential decay ΔV is confirmed (Yes in S16), the control portion 110 changes the toner image formation condition (S17), and then, restarts the interrupted copying operation (S12).

<Step 1>

Referring to FIGS. 2 and 6, as Step 1 begins to be carried out (S21), the image forming operation is interrupted, and the exposing apparatus 13*a* and pre-exposing apparatuses 17*a* and 18*a* are turned off. Further, the voltage application to the primary charging apparatus 12*a*, developing apparatus 14*a*, and primary transfer roller 35*a* is also stopped (S22).

Incidentally, before starting Step 1, the electrostatic memory of the photosensitive drum 11*a* is completely erased by rotating the photosensitive drum 11*a* several times, with the exposing apparatus 13*a* turned off, and pre-exposing apparatuses 17*a* and 18*a* left turned on.

Referring to FIG. 8, the control portion 110 changes in potential level, in three steps, the charge voltage applied to the charge roller 12*r* while applying 300 V of transfer voltage to the primary transfer roller 35*a* and keeping the pre-exposing apparatuses 17*a* and 18*a* turned off. That is, first, the control portion 110 detects the amount of the transfer current while applying −400 V of voltage to the charge roller 12*r* (S23). Then, it detects the amount of the transfer current while applying −600 V of voltage to the charge roller 12*r* (S24). Finally, it detects the amount of the transfer current while applying −800 V of voltage to the charge roller 12*r* (S25). Thus, the differences (transfer bias: transfer voltage minus charge voltage) in potential level between the voltage applied to the charge roller 12*r* and the voltage applied to the primary transfer roller 35*a* are 700 V, 900 V, and 1100 V, respectively.

Referring to FIG. 8, as soon as the values A, B, and C of the transfer current which correspond to the three transfer biases are 700 V, 900 V, and 1100 V, respectively, are obtained, the control portion 110 turns off the voltage being applied to the charge roller 12*r* and the voltage being applied to the primary transfer roller 35*a* (S26).

Then, the control portion 110 obtains, by approximation (as shown in FIG. 9), the linear relationship (numerical formula) between the amount of transfer bias Y and the amount of transfer current X, based on the data regarding the relationship between the transfer biases 700 V, 900 V, and 1100 V, and the transfer current values A, B, and C, with the use of a processing portion 200, (S27).

$$Y=aX+b \quad \text{(D).}$$

The processing portion 200 is provided with a memory capable of storing a simple numerical formula. Thus, it keeps numerical formula D stored until Step 2 is completed. The relationship between a desired surface potential level (potential level of photosensitive drum 11*a*) and the amount of transfer current can be obtained with the use of numerical formula D.

The volume resistance and surface resistance of the photosensitive drum 11*a* are substantially affected by the cumulative amount of the exposure of the photosensitive drum 11*a* to light. Therefore, the straight line which represents the relationship between the amount of transfer bias and the amount of transfer current when the photosensitive drum 11*a* is new is substantially different in slope from the slope when the photosensitive drum 11*a* is toward the end of its service life. Similarly, the volume resistance and surface resistance of the primary transfer roller 35*a*, and the volume resistance and surface resistance of the intermediary transfer belt 31 are also affected by the cumulative amount of transfer current and cumulative length of their usage. Therefore, the straight line which depicts the relationship between the amount of transfer bias and the amount of transfer current when the primary transfer roller 35*a* and intermediary transfer belt 31 are new is substantially different from that when the primary transfer 35*a* and intermediary transfer belt 31 are toward the end of their service lives.

As described above, the relationship between the amount of transfer current X and the amount of the transfer bias Y is affected by the cumulative number of the images (copies) formed by the image forming apparatus, and the cumulative number of component replacements. Thus, carrying out Step 1 is very important to accurately estimate the surface potential of the photosensitive drum 11*a* by accurately determining the state of the primary transferring portion T1.

Incidentally, a small amount of light may be emitted by the pre-exposing apparatuses 17*a* and 18*a* in Step 1, as long as the amount of the light is not large enough to cause the surface potential of the photosensitive drum 11*a* to decay.

As for the timing for resetting the charge voltage, the charge voltage may be reset immediately after the image forming apparatus 100 is turned on, immediately after the image forming apparatus is reset in the toner image formation condition each time the cumulative number of copies formed by the image forming apparatus reaches a preset value, or immediately after the primary transfer voltage (constant voltage) is set. As described above, the process of setting the primary transfer voltage (constant voltage) includes the subprocess of increasing in steps the transfer voltage to be applied to the primary transfer roller 35*a*. Therefore, Step 1 may be carried out as a part of the process of setting the primary transfer voltage.

Further, the charge voltage may be reset according to the amount of the current which flows through a brush or the like which is placed in contact with the photosensitive drum 11*a* while a voltage is applied to the brush or the like.

The interval with which the charge voltage is to be reset may be changed based on the environment in which the apparatus main assembly (100P in FIG. 1) is operated, and/or cumulative number of copies made before the resetting of the charge voltage. However, the interval with which the charge voltage is to be reset is desired to be once every 200 to 1,000 copies.

<Step 2>

Figure 10:
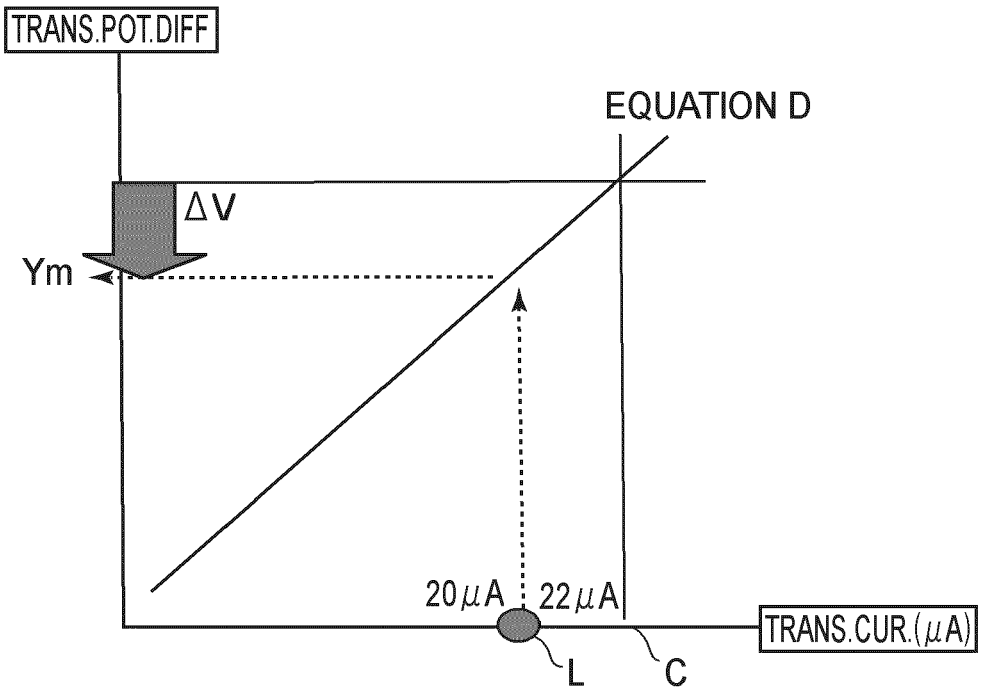
FIG. 10 is a graph showing the relationship among the amount of the transfer bias, the amount of the transfer current, and the amount of the surface potential decay, obtained in Step 2 in the first embodiment.

FIG. 10 is a graph showing the estimated amount of the surface potential decay obtained in Step 2.

Referring to FIGS. 2 and 7, in Step 2, the amount of the transfer current is measured while applying a preset transfer voltage to the charge roller 12*r* and making the pre-exposing apparatuses 17*a* and 18*a* emit the same amount of exposure light as that emitted during an image forming operation. Then, based on the relationship (numerical formula) between the amount of the transfer current X and the amount of the transfer bias Y, which was obtained in Step 1, the amount of the surface potential decay ΔV attributable to the pre-exposure is obtained.

Referring to FIG. 8, in Step 2 (S31), the control portion 110 applies +300 V of transfer voltage and then, applies −800 V of charge voltage, while keeping the pre-exposing apparatuses 17*a* and 18*a* turned on (S32). The control portion 110 measures the amount of the transfer current (which hereafter may be referred to as measured value L or transfer current L) at the surface of the photosensitive drum 11*a* which has just been charged to −800 V after being pre-exposed with 30 Lux.sec of exposure light (S32).

Referring again to FIG. 8, after measuring the amount of transfer current L, the control portion 110 turns off the pre-exposing apparatuses 17 and 18*a*, and then, turns off the voltage being applied to the charge roller 12*r* and the voltage being charged to the primary transfer roller 35*a* (S33).

Next, referring to FIG. 10, the control portion 110 substitutes the amount of transfer current L for the X in numerical formula D obtained in Step 1, obtaining the amount of the transfer bias Ym which includes the amount of the surface potential decay ΔV attributable to the pre-exposure (S34).

In Step 2, the amount of the transfer current L is measured at virtually the same time as when the amounts A, B, and C of the transfer current are measured in Step 1. Therefore, it may be thought that the amount of the resistance of the photosensitive drum 11*a*, the amount of the resistance of the intermediary transfer belt 31, and the amount of the resistance of the primary transfer roller 35*a*, in Step 2, which are included in numerical formula D are the same as those in Step 1. Therefore, the amount of the transfer current L may be substituted for X in numerical formula D.

Referring to FIG. 10, in Step 1, when the amount of the transfer bias was 1100 V, the amount of the transfer current C was 22 μA, whereas the amount of the transfer current L was 20 μA. Therefore, the amount of transfer bias Ym, which includes the amount of the surface potential decay ΔV, was 1050 V.

Here, the difference in potential level between −800 V of transfer voltage and 300 V of transfer voltage is equal to (Ym−ΔV). Therefore, the value of the surface potential decay ΔV can be obtained from the following numerical formula:

$$\Delta V=|(-800)-300|-|Ym| \quad \text{(E).}$$

The control portion 110 calculates the amount of the surface potential decay ΔV by substituting 1050 for Ym in numerical formula E (S35).

Referring to FIG. 10, ΔV=1100−1050=50V.

The control portion 110 adjusts the toner image formation settings in a manner to offset the calculated (estimated)

amount of the surface potential decay ΔV (S36). That is, the control portion 110 corrects the image formation settings in anticipation of the occurrence of dark decay so that the latent image contrast, that is, the difference in potential level between the dark point potential level, which is equal to the preset potential level to which the peripheral surface of the photosensitive drum 11*a* is to be charged, and the light point potential level, that is, the potential level of a given point of the peripheral surface of the photosensitive drum 11*a* after its exposure by the exposing means, becomes the preset potential level. In this embodiment, the image formation condition (setting) includes at least one among the charging condition (charging apparatus setting), the exposing condition (exposing apparatus setting), and the developing condition (developing apparatus setting).

More specifically, the formation of a foggy image, that is, one of the undesirable effects of the decay of the surface potential of the photosensitive drum 11*a* by 50 V, is prevented by raising by 50 V(=ΔV) the charge voltage to be applied to the charge roller 12*r* from the electric power source D3. The cause of the formation of a foggy image is as described above.

Incidentally, instead of changing the charge voltage applied to the charge roller 12*r*, the development voltage Vdc (development potential) to be applied to the development sleeve 14*s* from the electric power source D4 may be reduced by 50 V. That is, the formation of a foggy image can be prevented by reducing the development voltage Vdc from −650 V to 600 V to ensure that 150 V of difference is provided between the level of the dark point potential Vd (preset level to which photosensitive drum 11*a* is charged) and the potential level of the development voltage Vdc, as shown in FIG. 4. However, if the development voltage Vdc is reduced in potential level, the difference in potential level between the development voltage Vdc and light point potential VL reduces, which in turns reduces the amount by which toner adheres to the exposed points of the peripheral surface of the photosensitive drum 11*a*. Thus, in order to reduce the light point potential VL by 50 V, the intensity of the laser light beam emitted by exposing apparatus 13*a* must be increased.

Table 1 shows the results of the experiments in which the pre-exposing means, charging means, exposing means, developing means, transferring means, etc., were varied in settings in Step 1 and Step 2, and also, the toner image formation conditions (settings) were varied.

TABLE 1

| | Integrated No. of processed sheets | STEP 1 charge Vol. (V) First | 2nd | 3rd | 4th | PreExp. (Lux. Sec) | 1ry Trans. Vol. (V) | STEP 2 Charge Vol. (V) | PreExp. (Lux-sec) | Attenuation (V) | Feed-back |
|---|---|---|---|---|---|---|---|---|---|---|---|
| 1 | 0 | −400 | −600 | −800 | | 0 | 300 | −800 | 30 | 50 | Ch.V.: 50 V up |
| 2 | 0 | −200 | −400 | −600 | −800 | 0 | 300 | −800 | 30 | 50 | Ch.V.: 50 V up |
| 3 | 0 | −400 | −600 | −800 | | 0 | 500 | −800 | 30 | 50 | Ch.V.: 50 V up |
| 4 | 0 | −400 | −600 | −800 | | 0 | 300 | −600 | 30 | 45 | Ch.V.: 45 V up |
| 5 | 0 | −400 | −600 | −800 | | 0 | 300 | −800 | 20 | 40 | Ch.V.: 40 V up |
| 6 | 100000 | −400 | −600 | −800 | | 0 | 300 | −800 | 30 | 80 | Ch.V.: 80 V up |
| 7 | 0 | −400 | −600 | −800 | | 0 | 300 | −800 | 30 | 50 | Dev.V: 50 V dwn Exp: 2Lux.sec up |
| 8 | 0 | −400 | −600 | −800 | | 1 | 300 | −800 | 30 | 50 | Ch.DC.V: 50 V up |

In addition to the combinations of image formation settings shown in Table 1, there are more combinations of image formation settings, which can be adjusted according to the estimated amount of the surface potential decay ΔV obtained by varying the voltage settings in Step 1 and Step 2.

The amount of the surface potential decay ΔV can also be estimated using a surface potential level for the photosensitive drum, a number of steps in which the charge voltage is changed, an order in which changes are made, transfer voltage settings, pre-exposure light settings, etc., which are different from those used in Step 1 and Step 2.

The pre-exposing apparatuses 17*a* and 18*a* do not need to be turned on at the same time. That is, the pre-exposing apparatuses 17*a* and 18*a* may be individually turned on so that the amount of the surface potential decay ΔV attributable to the pre-exposure by the pre-exposing apparatus 17*a* and the amount of the surface potential decay ΔV attributable to the pre-exposure by the pre-exposing apparatus 18*a* can be individually calculated, and then, added. In this case, however, the difference in amount between the transfer current L and the transfer current C in Step 1 is smaller than that obtained by turning on the pre-exposing apparatuses 17*a* and 18*a* at the same time, by the amount equal to the amount by which the charge carriers is reduced. Therefore, this method may be lower in control accuracy than the method used in this embodiment.

Embodiment 2

Figure 11:
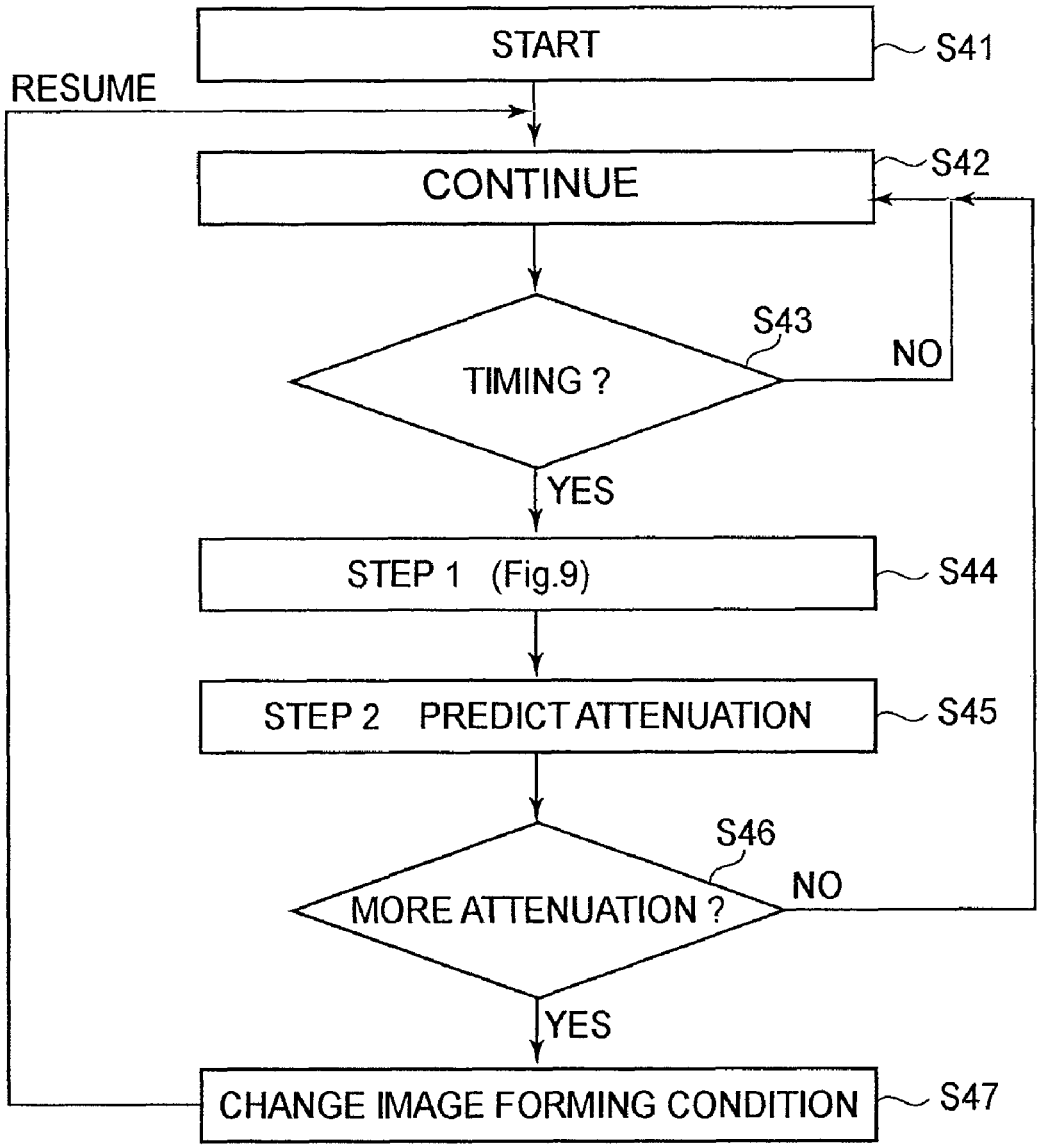
FIG. 11 is a flowchart of the charge voltage resetting operation according to a second embodiment of the present invention.
Figure 12:
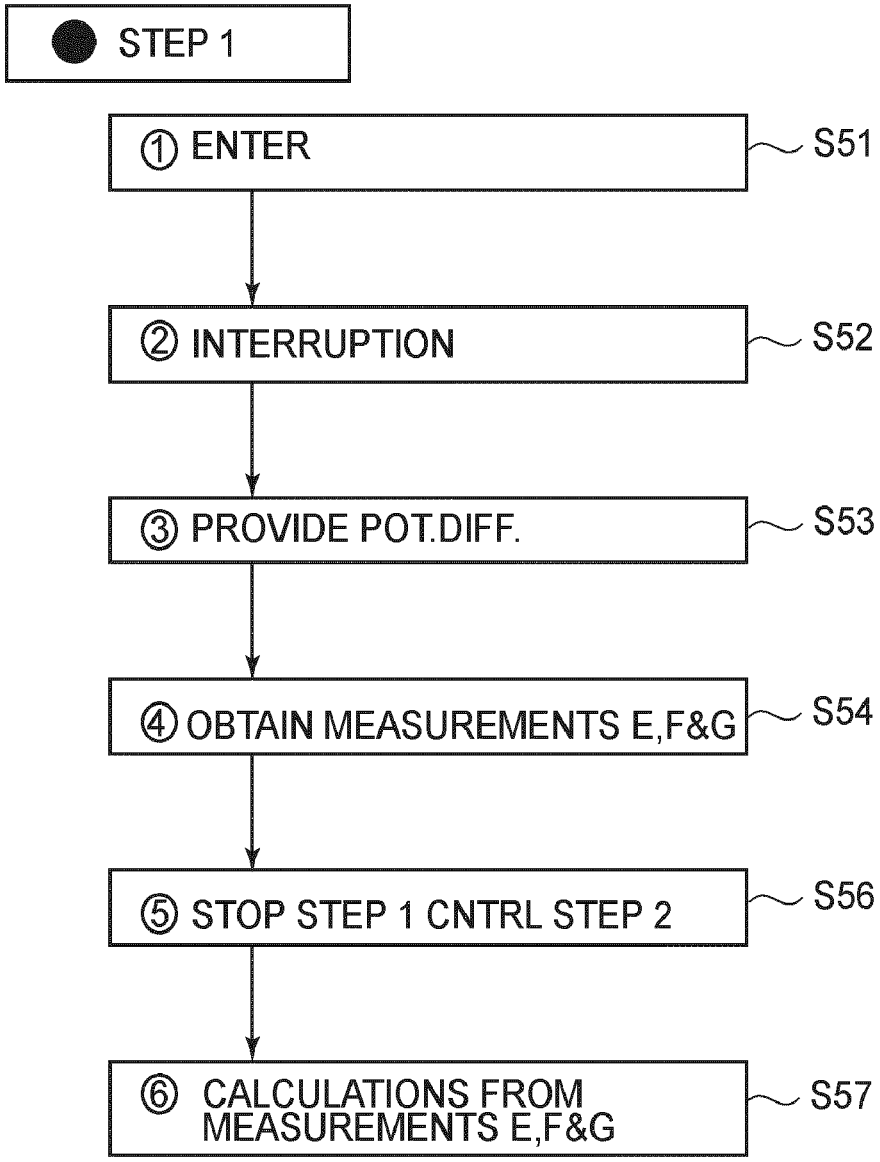
FIG. 12 is a flowchart of Step 1 of the charge voltage resetting operation in the second embodiment.
Figure 13:
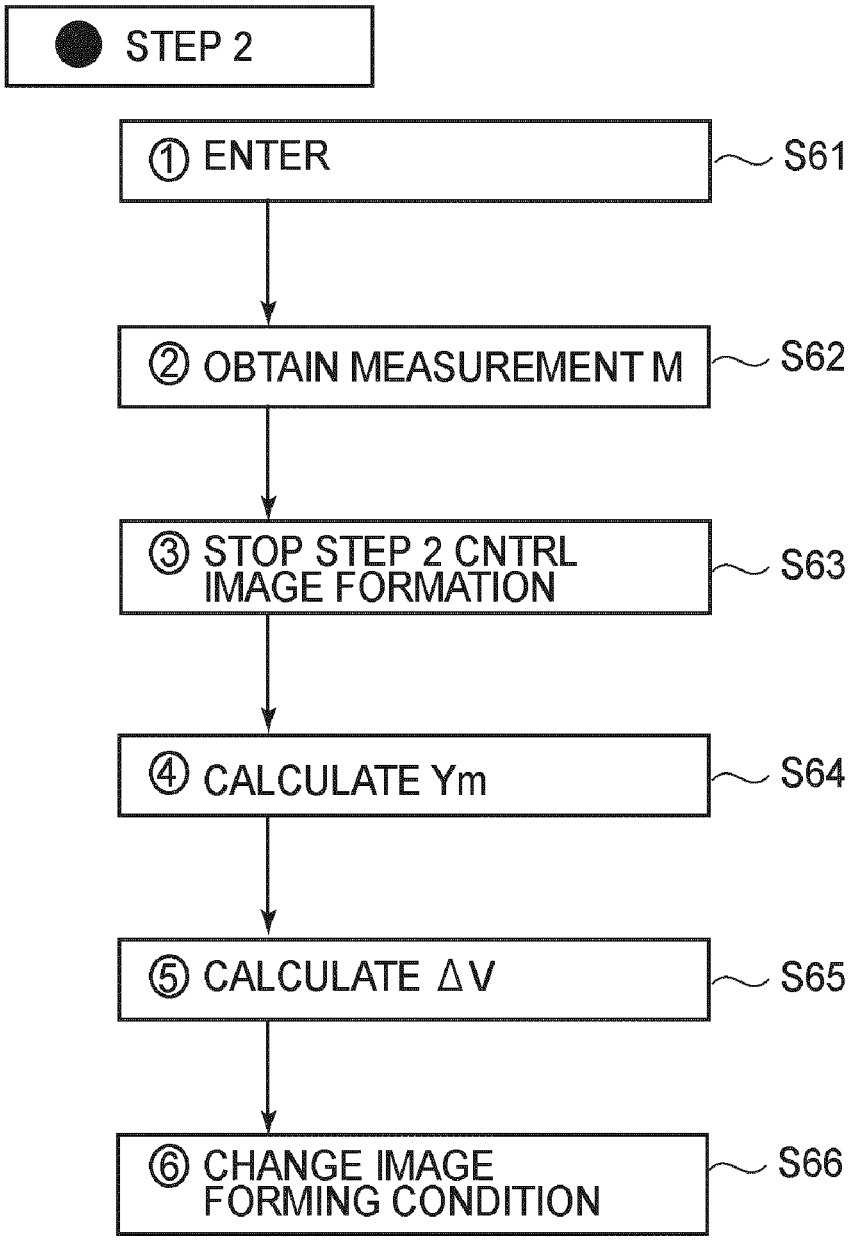
FIG. 13 is a flowchart of Step 2 of the charge voltage resetting operation in the second embodiment.
Figure 14:
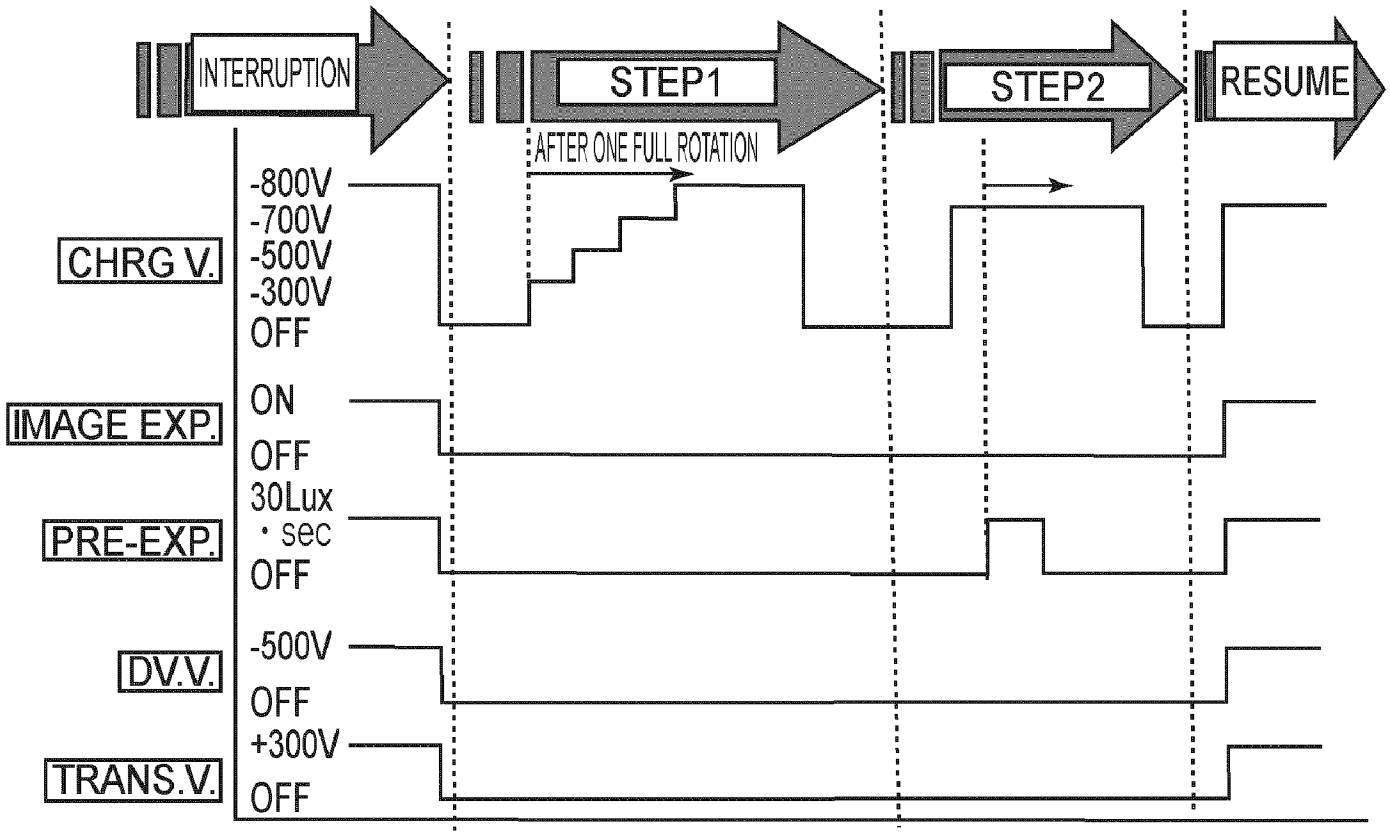
FIG. 14 is a timing chart of the charge voltage resetting operation in the second embodiment.
Figure 15:
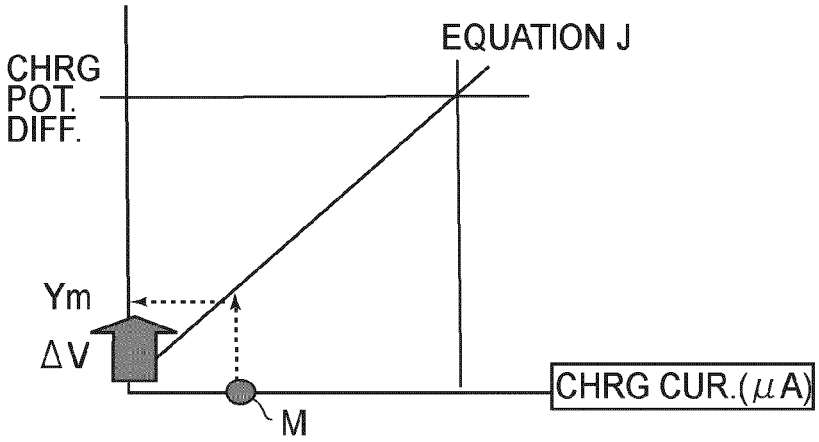
FIG. 15 is a graph showing the relationship among the amount of the charge bias, the amount of the charge current, and the amount of the surface potential decay, obtained in Step 2.

FIG. 11 is a flowchart of the charge voltage resetting control, and FIG. 12 is a flowchart of Step 1 in FIG. 11 (flowchart of the charge voltage resetting control). FIG. 13 is a flowchart of Step 2 in FIG. 11 (flowchart of charge voltage resetting control), and FIG. 14 is a timing chart of the charge voltage resetting control. FIG. 15 is a graph showing the estimated amount of the charge decay obtained in Step 2.

In the second embodiment, the amount of the current which flows into the charge roller 12*r* in the image forming apparatus 100, which was described with reference to FIGS. 1-4, is detected. Then, the amount of the surface potential decay ΔV attributable to the pre-exposure is obtained based on the detected amount of the current which flowed into the charge roller 12*r*. Then, the obtained value) the surface potential decay ΔV is fed back to the toner image formation conditions.

The primary charging apparatus 12*a*, which is an example of a charging means, has the charge roller 12*r*, which is an example of a charging member. The charge roller 12*r* is in contact with the peripheral surface of the photosensitive drum

11*a*, which is an example of a photosensitive member. To the charge roller 13*r*, a combination of DC voltage and AC voltage is applied.

A current detection circuit A3 and a transfer current amount measuring portion 201, which are examples of a current detecting means, detect the amount of current which is made to flow between the peripheral surface of the charge roller 12*r* and the peripheral surface of the photosensitive drum 11*a* by the DC voltage. The timing of the detection is when the portion of the peripheral surface of the photosensitive drum 11*a*, which was charged by applying voltage to the charge roller 13*r*, which is an example of a charging member, during the immediately preceding rotation of the photosensitive drum 11*a*, comes around back to the charge roller 12*r*.

In the second embodiment, the difference between the amount of the surface potential of the photosensitive drum 11*a*, which is measured when the photosensitive drum 11*a* is not pre-exposed, and that when the photosensitive drum 11*a* is pre-exposed is obtained as the amount of the surface potential decay ΔV attributable to the pre-exposure. When the amount of the surface potential of the photosensitive drum 11*a* is measured without the pre-exposure, and when the amount of the surface potential of the photosensitive drum 11*a* is measured with the pre-exposure, are roughly the same. Therefore, the amount of the surface potential decay ΔV attributable to the pre-exposure can be accurately measured under the same condition in terms of the electrical resistance of the charge roller 12*r* and photosensitive drum 11*a*. It is as described above that the electrical resistance of the charge roller 12*r* and the electrical resistance of the photosensitive drum 11*a* are significantly affected by such factors as the cumulative length of their usage, the cumulative number of copies outputted using them, and the cumulative amount of their exposure.

As in the case of the first embodiment, in a case where the photosensitive drum 11*a* is small in diameter and is rotated at a high speed, if the photosensitive drum 11*a* is not pre-exposed, the surface potential of the photosensitive drum 11*a* decays very little. Thus, the amount of the surface potential of the photosensitive drum 11*a* can be accurately calculated based on the amount of the charge voltage being applied to the charge roller 12*r* and the amount of the charge current. Therefore, a numerical formula J, which accurately shows the relationship between the amount of the charge current and the potential level to which the photosensitive drum 11*a* will be charged, can be created, making it possible to accurately obtain the amount of the surface charge decay attributable to the pre-exposure under the condition in which the dark decay is desired to be measured.

In the case where the amount of the surface potential of the photosensitive drum 11*a* is measured after the pre-exposure, a given area of the peripheral surface of the photosensitive drum 11 is charged by moving once through the interface between the charge roller 12*r* and photosensitive drum 11*a* after it is exposed by the pre-exposing apparatuses 17*a* and 18*a*. Thereafter, the pre-exposing apparatuses 17*a* and 18*a* are turned off, and the photosensitive drum 11*a* is rotated once so that the surface potential of the same area of the peripheral surface of the photosensitive drum 11*a* is detected while passing by the charge roller 12*r* without being pre-exposed.

<Control of Resetting of Charge Voltage>

Referring to FIGS. 2 and 11, as a copying operation is started (S41), the control portion 110 continues the copying operation (S42) until the copy count accumulated in the counter-memory 203 reaches 500 (No in S43).

As the copy count in the counter-memory 203 reaches 500 (Yes in S43), the control portion 110 carries out Step 1 (S44).

Referring to FIG. 12, in Step 1, the potential level of the DC component (charge voltage) of the voltage to be applied to the charge roller 12*r* is changed, in multiple steps, with the pre-exposing apparatuses turned off The charge voltage reciprocates between the photosensitive drum 11*a* and charge roller 12*r* by being borne on the AC component, that is, the other components of the charge voltage, charging the peripheral surface of the photosensitive drum 11*a* to a potential level equal to the potential level of the charge voltage. At each of the multiple potential levels, the amount of charge current, which corresponds to a given area of the peripheral surface of the photosensitive drum 11*a*, is measured as the given area is brought back to the charge roller 12*r* by a single full rotation of the photosensitive drum 11*a* after being charged by the charge roller 12*r*. Then, the relationship between the amount of the charge current and the level of the charge potential of the photosensitive drum 11*a* when there is no surface potential decay attributable to the pre-exposure, is calculated for each potential level of the DC voltage applied to the charge roller 12*r*.

After the completion of Step 1, the control portion 110 carries out Step 2 (S45).

In Step 2, as will be described later with reference to FIG. 13, the amount of the charge current is detected while the pre-exposing apparatuses 17*a* and 18*a* are kept on, with the amount of their exposure light set to the same value as the amount of the exposure light emitted for image formation. Then, based on the relationship between the amount of charge current and the level of the surface potential of the photosensitive drum 11*a*, which was obtained in Step 1, the amount of the surface potential decay ΔV attributable to the pre-exposure light, which is the same in intensity as the exposure light emitted during an image forming operation is estimated.

If the presence of the surface potential decay ΔV attributable to the pre-exposure is not confirmed in Step 2 (No in S46), the copying operation is continued without resetting the toner image formation conditions (settings) (S42). On the other hand, if the presence of the surface potential decay ΔV is confirmed (Yes in S46), the toner image formation conditions (settings) (S47) of the image forming apparatus are adjusted, and then, the copying operation is resumed (S42).

<Step 1>

Referring to FIGS. 2 and 12, as Step 1 begins to be carried out (S51), the image forming operation is interrupted, and the exposing apparatus 13*a* and pre-exposing apparatuses 17*a* and 18*a* are turned off. Further, the voltage application to the primary charging apparatus 12*a*, developing apparatus 14*a*, and primary transfer roller 35*a* is also stopped (S52).

Incidentally, before the starting of Step 1, the electrostatic memory of the photosensitive drum 11*a* is completely erased by rotating the photosensitive drum 11*a* several times, with the exposing apparatus 13*a* turned off, but, the pre-exposing apparatuses 17*a* and 18*a* left turned on. Further, through Step 1 and Step 2, the primary transfer roller 35*a* is kept in a state of floating electrically, in order to minimize its effect upon the surface potential of the photosensitive drum 11*a*.

Referring to FIG. 14, the control portion 110 changes the potential level, in three steps, the charge voltage applied to the charge roller 12*r*. That is, it applies to the charge roller 12*r* for 50 msec in succession a combination of −300 V of DC voltage (charge voltage Vd) and 1.5 kVpp of AC voltage, a combination of −500 V of DC voltage (charge voltage Vd) and 1.5 kVpp of AC voltage, and a combination of −700 V of DC voltage (charge voltage Vd) and 1.5 kVpp of AC voltage (S53). In this embodiment, the value of the potential level of the charge voltage applied during a normal image forming operation is −700 V.

Therefore, three areas, which are 15 mm (=300 mm/sec×50 msec) in the dimension parallel to the rotational direction of the photosensitive drum 11*a*, and are −300 V, −500 V, and −700 V (which correspond to above-mentioned three potential levels of charge voltage), are consecutively formed on the peripheral surface of the photosensitive drum 11*a*.

As each area is returned to the charge roller 12*r* by a single full rotation of the photosensitive drum 11*a*, the control portion 110 measures the amount of the charge current between the charge roller 12*r* and each of the above-mentioned three areas of the photosensitive drum 11*a*, by the current detection circuit A3 and charge current measuring portion 202, while applying −800 V of charge voltage to the charge roller 12*r* (S54). Thus, the amount of difference in potential level between the above-mentioned three areas of the peripheral surface of the photosensitive drum 11*a*, which are charged when the charge voltage Vd is 300 V, −500 V, and −700 V, which are obtained by subtracting −800 V, are 500 V, 300 V, and 100 V, respectively.

In Step 1, the potential level of the charge voltage to be applied to the charge roller 12*r* to measure the amount of charge current, which corresponds each of the above-mentioned three areas, is set to −800 V, which is higher than the potential level (−700 V) to which the photosensitive drum 11*a* is to be charged for a normal image forming operation. Therefore, the amount of difference in potential level provided between each of the above-mentioned three different charged areas of the peripheral surface of the photosensitive drum 11*a* and the charge voltage is large enough to reduce the amount of the error in the measurement of the charge current. In other words, in this embodiment, the amount of the error in the measurement of the amount of the charge current is reduced by increasing in potential level the voltage applied to the charge roller 12*r* to measure the amount of charge current in Step 2. Further, as the electrical resistance of the charge roller 12*r* and photosensitive drum 11*a* reduce due to the cumulative length of their usage, or their age, they must be compensated for their reduction in electrical resistance. Therefore, the following control may be carried out to compensate for their reduction in electrical resistance: In Step 1, the charge voltage is set so that charge current flows by a significant amount, and the charge voltage is adjusted to nullify the effects of the changes in the electrical resistance of the charge roller and photosensitive drum, based on the results of the detection and amount of the difference obtained in Step 2.

Referring to FIG. 14, as the values E, F, and G of the charge current which correspond to the potential levels −300 V, −500 V, and −700 V of the charge voltage, respectively, are obtained, the control portion 110 turns off the voltage being applied to the charge roller 12*r* (S56).

Then, the control portion 110 obtains, by approximation, the linear relationship (numerical formula J) between the amount of the charge bias Y and the amount of the charge current X, based on the data regarding the relationship between the charge bias amounts 500 V, 300 V, and 100 V, and the charge current values E, F, and G, respectively, with the use of a processing portion 200 as shown in FIG. 9 (S57). The numerical formula J is stored until Step 2 is completed:

$$Y=eX+f \quad \text{(J)}.$$

In Step 1, three areas different in potential level are created on the peripheral surface of the photosensitive drum 11*a*. Instead, however, three areas which are −300 V, −500 V, and −700 V, respectively, may be created on the peripheral surface of the photosensitive drum 11*a* for every second full rotation of the photosensitive drum 11*a* (with an interval of a single full rotation of the photosensitive drum 11*a*). In this case, the amount of charge current is measured, with the potential level of the voltage applied to the charge roller 12*r* set to −700 V during the rotation of the photosensitive drum 11*a* following each of the three rotations of the photosensitive drum 11*a*, during which the three areas which are −300 V, −500 V, and −700 V in potential level, are created, one for one, on the peripheral surface of the photosensitive drum 11*a*.

<Step 2>

Referring to FIGS. 2 and 13, in Step 2, the photosensitive drum 11*a* is charged by applying a preset charge voltage to the charge roller 12*r* after the photosensitive drum 11*a* is pre-exposed by the pre-exposing apparatuses 17*a* and 18*a*, the intensity of which is set to the same level as that for a normal image forming operation. Thereafter, the amount of the charge current is measured after the photosensitive drum 11*a* is rotated one full turn, with the pre-exposing apparatuses 17*a* and 18*a* kept turned off. Then, based on the relationship (numerical formula) between the amount of the charge current X and the amount of the charge bias Y, which was obtained in Step 1, the amount of the surface potential decay ΔV attributable to the pre-exposure is obtained.

In Step 2, the control portion 110 applies +700 V of charge voltage, which is the same as the charge voltage applied for a normal image forming operation, to the charge roller 13*r*, while keeping the pre-exposing apparatuses 17*a* and 18*a* turned on, as shown in FIG. 14 (S62). As soon as the photosensitive drum 11*a* is rotated once while being charged, the control portion 110 turns off the pre-exposing apparatuses 17*a* and 18*a* to prevent the charged area of the photosensitive drum 11*a* from being affected by the pre-exposing apparatuses 17*a* and 18*a*.

The control portion 110 measures, with the use of the charge current amount detecting means, the amount of the charge current M, that is, the charge current which flows while a given area of the peripheral surface of the photosensitive drum 11*a* is charged to −700 V after it is pre-exposed with the intensity of the pre-exposure light set to 30 Lux.sec (S62). The potential level of the charge voltage applied when measuring the amount of the charge current M is −700 V.

Referring again to FIG. 14, after measuring the amount of the charge current M, the control portion 110 turns off the voltage being applied to the charge roller 12*r* (S63).

Next, referring to FIG. 15, the control portion 110 substitutes the measured value of the charge current M for the X in the numerical formula J obtained in Step 1, obtaining the amount of the charge bias Ym which includes the amount of the surface potential decay ΔV attributable to the pre-exposure (S64).

In Step 2, the amount of the charge current M is measured at virtually the same time as when the amounts E, F, and G of the charge current are measured in Step 1. Therefore, it may be thought that the amount of the electrical resistance of the photosensitive drum 11*a*, amount of the electrical resistance of the charge roller 12*r*, which are included in the numerical formula J are the same as the counterparts in Step 1. Therefore, the value of the charge current M may be substituted for X in numerical formula J obtained in Step 1.

Here, the difference in potential level between −700 V of charge voltage and −700 V of the surface potential of the photosensitive drum 11*a* is 0 V (−700 V−(−700 V)=0 V), which is equal to (Ym−ΔV). Therefore, the amount of the surface charge decay ΔV can be obtained from the following numerical formula:

$$\Delta V=|Ym| \quad (K).$$

The control portion 110 calculates the amount of the charge decay ΔV which includes the amount of the charge decay attributable to the pre-exposure and the amount of the ordinary dark decay, that is, the dark decay which is not attributable to the pre-exposure, by substituting the obtained value for Ym in numerical formula K (S35). Referring to FIG. 15, the amount of the surface potential decay ΔV is 50 V (ΔV=50 V).

The control portion 110 adjusts the toner image formation settings in a manner to offset the calculated amount of the surface potential decay ΔV (S66).

More specifically, the formation of a foggy image, that is, one of the undesirable effects of the decay of the surface potential of the photosensitive drum 11*a* by 50 V, is prevented by raising by 50 V the charge voltage to be applied to the charge roller 12*r* from the electric power source D3. The cause of the formation of a foggy image is as described above.

Incidentally, as will be evident from FIG. 4, it takes a certain amount of time for a given area of the peripheral surface of the photosensitive drum 11*a*, which was charged after it was pre-exposed, to stabilize the amount of surface potential decay. Therefore, it is desired that the timing with which the amount of the charge current is measured in Step 2 is after the elapse of a sufficient amount of time for the amount of the surface potential decay ΔV attributable to the pre-exposure to stabilize.

Regarding Step 2 in the second embodiment, it is confirmed that when a given area of the peripheral surface of the photosensitive drum 11*a*, which has just been exposed by the pre-exposing apparatuses 17*a* and 18*a*, passes by the charge roller 12*r* because of the first full rotation of the photosensitive drum 11*a* after the charging of the given area, the given area has not stabilized in surface potential level. Therefore, the timing with which the amount of the charge current is measured in Step 2 is set to a time when a given area of the peripheral surface of the photosensitive drum 11*a*, which has just been exposed by the pre-exposing apparatuses 17*a* and 18*a*, passes by the charge roller 12*r*, because of the second full rotation of the photosensitive drum 11*a* after the charging of the given area.

Table 2 shows the results of the experiments in which the pre-exposing means, the charging means, the exposing means, the developing means, the transferring means, etc., were varied in settings in Step 1 and Step 2, and also, the toner image formation conditions (settings) were varied.

TABLE 2

| | Integrated No. of processed sheets | STEP 1 charge Vol. (V) First | 2nd | 3rd | 4th | PreExp. (Lux. Sec) | 1ry Trans. Vol. (V) | STEP 2 Charge Vol. (V) | PreExp. (Lux-sec) | Attenuation (V) | Feed-back |
|---|---|---|---|---|---|---|---|---|---|---|---|
| 1 | 0 | −300 | −500 | −700 | −800 | 0 | 0 | −700 | 30 | 50 | Ch.V: 50 V up |
| 2 | 0 | −200 | −400 | −600 | −800 | 0 | 0 | −700 | 30 | 50 | Ch.V: 50 V up |
| 3 | 50000 | −300 | −500 | −700 | −800 | 0 | 0 | −700 | 30 | 70 | Ch. V: 70 V up |
| 4 | 0 | −300 | −500 | −700 | −800 | 0 | 0 | −700 | 30 | 50 | Dev. V: 50 V dwn Exp: 2 Lux.sec up |

<Supplementary Description of Dark Decay>

Under the conditions that the pre-exposing apparatuses and the exposing apparatus are not activated, charge carriers are not generated in the photosensitive layer of the photosensitive drum. The phenomenon that the surface potential level of a photosensitive drum reduces with the elapse of time because the surface charge of the photosensitive drum is robbed by moisture, dust, etc., in the air is generally called dark decay. Generally, dark decay occurs in a case where a photosensitive drum with a large diameter (84 mm-108 mm), that is, in a case where the physical distance from a charging position to a developing position, and the physical distance from the charging position to a transferring position, are substantial, and therefore, it takes a significant amount of time for a given area of the peripheral surface of a photosensitive drum to reach the developing position and transferring position after the area is charged. In other words, dark decay is unlikely to occur in a case where the diameter of a photosensitive drum is small (30 mm-60 mm).

Dark decay is more conspicuous in a case where a charging method of a noncontact type, such as a corona-based charging method, which does apply a combination of a DC voltage and an AC voltage to a charging member is employed, whereas it is less likely to occur in a case where a charging method of a contact type, which applies a combination of a DC voltage and an AC voltage to a charging member is employed. A charging method of a contact type which applies a combination of a DC voltage and an AC voltage to a charging member, gives a greater amount of electric charge to the photosensitive layer of a photosensitive drum than the amount of electric charge which a charging method of a noncontact type gives. Thus, in the case where a charging method of a contact type, which applies a combination of a DC voltage and an AC voltage to a charging member is employed, even if the surface charge of a photosensitive drum robbed by moisture and dust in the air, the amount by which the surface charge is robbed is not large enough to significantly affect the amount of the surface potential which is applied to a photosensitive drum by a charging method of a contact type which uses a combination of a DC voltage and an AC voltage.

<Supplementary Description of Pre-Exposing Apparatus>

Figure 16:
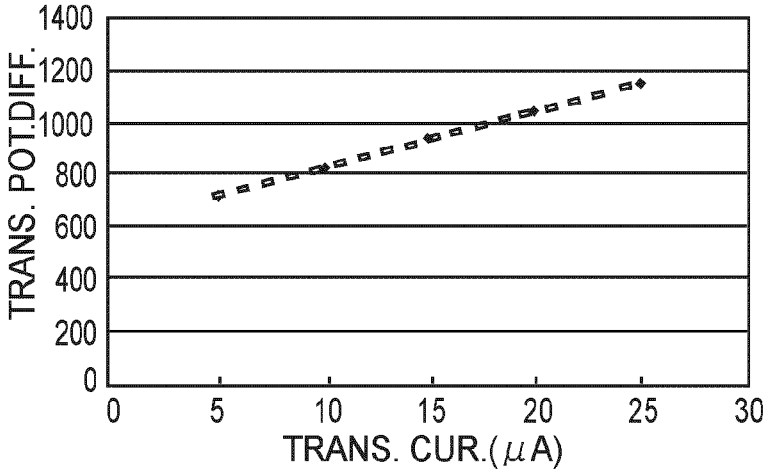
FIG. 16 is a graph showing the linear relationship between the amount of transfer current and the amount of the transfer bias.
Figure 17:
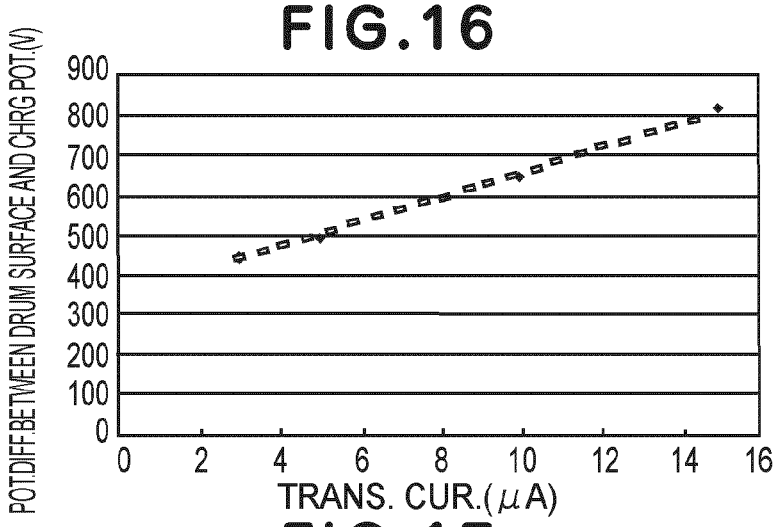
FIG. 17 is a graph showing the linear relationship between the amount of the charge current, and the amount of the difference in potential level between the surface potential of the photosensitive drum and the charge voltage.

FIG. 16 is a graph showing the linear relationship between the amount of the transfer current and the amount of the transfer bias, and FIG. 17 is a graph showing the linear relationship between the amount of charge current and the difference in potential level between the surface potential of a photosensitive drum and the charge voltage.

In a case where an electrophotographic image forming apparatus used to copy, in large numbers, an image having halftone areas, after it is used to continuously copy an image which is high in contrast, an image (copy) in which a faint pattern which reflects the pattern of the image which was formed (copied) in the preceding image forming operation is detectible is yielded. This phenomenon is called a ghost.

As a means for preventing an electrophotographic image forming apparatus from forming an image having a ghost, the apparatus is provided a pre-exposing apparatus, which illuminates the peripheral surface of the photosensitive drum with the light from LEDs to generate so-called photocarriers (charge carriers) in the photosensitive layer of the photosensitive drum. The photocarriers move to the surface of the photosensitive drum, and make uniform the surface potential of the photosensitive drum.

Referring to FIG. 4, it takes a certain amount of time for the photocarriers to move to the surface of the photosensitive drum. Therefore, it takes a certain amount of time for the peripheral surface of the photosensitive drum to stabilize in surface potential after the pre-exposure. Thus, the dark decay attributable to the pre-exposure may be defined as the following phenomenon: As a given area of the peripheral surface of the photosensitive drum, which has not stabilized in surface potential, that is, a given area of the peripheral surface of the photosensitive drum, in which photocarriers remain, passes by the charging apparatus, the given area is reduced in potential level by the remaining photocarriers, after the area is charged.

Therefore, the decay of the surface charge of a photosensitive member (drum), to which the present invention relates, is strictly the phenomenon that is caused by the portion of the photocarriers, which is generated in the surface layer of the photosensitive member by the pre-exposer, and remains in the surface layer of the photosensitive member even when the photosensitive member is charged.

A surface potential level sensor (potentiometer, for example), which is one of the means for estimating the surface potential level of the a photosensitive drum, can be placed only in an image forming system (apparatus), the photosensitive member of which is large in diameter. Thus, it cannot be placed in the image forming apparatus 100 in the first embodiment, because the image forming apparatus 100 is an image forming system which uses a photosensitive drum which is 30 mm or less in diameter, and therefore, lacks the space for the surface potential level sensor.

A method for estimating drum potential level, based on the amount of transfer current, which is one of the values usable for estimating the surface potential level of a photosensitive drum, is problematic in terms of accuracy. That is, if this method is used throughout the service life of a photosensitive drum and the service life of a transferring member, without modification, the surface potential level of the photosensitive drum cannot be accurately estimated.

The value of the volume resistance of a photosensitive drum and the value of the volume resistance of a transferring member, which are measured when the photosensitive drum and transferring member are new, are significantly different from those which are measured toward the end of the service life of the photosensitive drum and transferring member. Therefore, even if the difference in potential level between the surface potential and the voltage applied to the transferring member, which is obtained when the photosensitive drum and transferring member are new, and the difference obtained toward the end of their service life, are the same, the amount by which the transfer current flows when the photosensitive drum and transferring member are new, are different from that which flows when the photosensitive drum and transferring member are in the end portion of their service life.

Further, the electrical resistance of a photosensitive drum and a transferring member is affected by temperature. Therefore, the amount of the electrical resistance of a photosensitive drum and the amount of the electrical resistance of a transferring member, which are measured immediately after the starting of a copying operation in which a large number of sheets of recording paper are continuously fed into the image forming apparatus, and those measured after a substantial number of sheets of recording paper are conveyed through the image forming apparatus, are significantly different. Therefore, it is difficult to accurately estimate the difference (contrast) between the surface potential level of the photosensitive drum and the potential level of the charge voltage, even in this type of situation.

However, in the case of the first embodiment, the amount of the charge current is measured after the photosensitive drum is pre-exposed for a preset length of time, and also, without subjecting the photosensitive drum to virtually or absolutely no pre-exposure light. Therefore, even if the photosensitive drum and transferring member change in electrical resistance, it is possible to accurately estimate the amount by which the surface potential of the photosensitive drum reduces (decays) when the photosensitive drum is pre-exposed, under the same condition in terms of electrical resistance.

Also in this embodiment, the characteristic of the photosensitive drum that when the photosensitive drum is exposed to virtually no pre-exposure light, the amount of dark decay is virtually zero, is utilized. Therefore, the surface potential level of the photosensitive drum at a given point in time can be estimated based on the voltage being applied to the charging member at the given point in time. Therefore, it is possible to accurately know the relationship, at a given point in time, between the amount of the transfer current and the difference in potential level between the surface potential of the photosensitive drum and the transfer voltage. Therefore, whenever it is necessary to know (estimate) the amount of the surface charge decay attributable to pre-exposure, the amount of the surface charge decay attributable to pre-exposure can be accurately obtained.

Thus, according to the first embodiment, it is possible to accurately obtain the relationship between the amount of the transfer current and the amount of transfer bias (FIG. 16) without using a surface potential level sensor (potentiometer) dedicated to the measurement of the surface potential of the photosensitive drum. Also according to the first embodiment, it is possible to accurately estimate the amount of the surface charge decay attributable to pre-exposure, to the end of the service life of the photosensitive drum and transferring member, even if the photosensitive drum and/or transferring member changes in electrical resistance due to their deterioration and/or changes in the ambient temperature.

Further, according to the second embodiment, it is possible to accurately estimate the relationship between the amount of the charge current, and the difference in potential level between the surface potential of the photosensitive drum and the charge voltage (FIG. 17), without using a surface potential level sensor (potentiometer) dedicated to the measurement of the surface potential of the photosensitive drum. Therefore, it is possible to accurately estimate the amount of the surface charge decay attributable to pre-exposure to the end of the service life of the photosensitive drum and charging member, even if the photosensitive drum and charging member deteriorate, even if their electrical resistance changes due to changes in the ambient temperature, and/or even if the environment in which the image forming apparatus is used drastically changes.

In other words, according to the present invention, it is possible to provide a method for estimating the amount of the surface charge decay, that is, one of the problems which occurs in an electrophotographic image forming apparatus designed to pre-expose its photosensitive drum with its pre-exposing apparatus(es), which is more accurate than a corresponding conventional method, and therefore, is capable of enabling an electrophotographic image forming apparatus to continuously output a large number of copies (images) which is significantly higher in quality than an image which can be outputted with the use of the conventional method, and which is lower in cost than the conventional method.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 194714/2007 filed Jul. 26, 2007 which is hereby incorporated by reference.

What is claimed is:

1. An image forming apparatus comprising:

a photosensitive member;

a charging device for charging said photosensitive member;

an exposure device for exposing said photosensitive member charged by said charging device in accordance with image information;

a developing device for developing, with toner, an electrostatic image formed on said photosensitive member by said exposure device into a toner image;

a transfer charger for transferring the toner image formed on said photosensitive member by said developing device onto an image receiving member in a transfer portion;

pre-exposure means, provided downstream of said transfer charger and upstream of said charging device with respect to a rotational direction of said photosensitive member, for electrically discharging by pre-exposure of said photosensitive member with light;

a current detector for detecting a current flowing through said transfer charger;

calculating means for calculating an amount of decrease of a photosensitive member potential due to pre-exposure of said photosensitive member; and correcting means for correcting an image forming condition on the basis of the amount calculated by said calculating means, wherein said calculating means determines a property formula on the basis of a first current, detected by said current detector, flowing between said transfer member and an area of said photosensitive member charged by said light discharger which is supplied with a first DC voltage substantially without being discharged by said pre-exposure means, and a second current, detected by said current detector, flowing between said transfer member and an area of said photosensitive member charged by said charging device which is supplied with a second DC voltage substantially without being discharged by said pre-exposure means, and wherein said calculating means calculates a correction amount of said correcting means on the basis of the property formula and a current flowing between said transfer member and an area of said photosensitive member charged by said charging device which is supplied with a predetermined DC voltage with discharging by said pre-exposure means.

2. An apparatus according to claim 1, further comprising a setting device for setting a light projection condition of said pre-exposure means when a charging bias voltage is corrected by said correcting means such that the condition is substantially the same as condition when said photosensitive member is discharged.

3. An apparatus according to claim 1, wherein a charging bias voltage is in the form of an AC voltage component biased by a DC voltage component, and said correcting means corrects the DC voltage component on the basis of the outputs of said current detector.

4. An image forming apparatus comprising:

a photosensitive member;

a charging device for charging said photosensitive member in a charging portion;

an exposure device for exposing said photosensitive member charged by said charging device in accordance with image information;

a developing device for developing, with toner, an electrostatic image formed on said photosensitive member by said exposure device into a toner image;

a transfer charger for transferring the toner image formed on said photosensitive member by said developing device onto an image receiving member in a transfer portion;

pre-exposure means, provided downstream of said transfer charger and upstream of said charging device with respect to a rotational direction of said photosensitive member, for electrically discharging by pre-exposure of said photosensitive member with light;

a current detector for detecting a current flowing through said charging device;

calculating means for calculating an amount of decrease of a photosensitive member potential due to a preexposure of said photosensitive member; and correcting means for correcting an image forming condition on the basis of the amount calculated by said calculating means, wherein said calculating means determines a property formula on the basis of a first current, detected by said current detector, flowing between said charging device and an area of said photosensitive member charged by said charging device which is supplied with a first DC voltage substantially without being discharged by said pre-exposure means, and a second current, detected by said current detecting means, flowing between said charging device and an area of said photosensitive member charged by said charging device which is supplied with a second DC voltage substantially without being discharged by said pre-exposure means, and wherein said calculating means calculates a correction amount of said correcting means on the basis of the property formula and a current flowing between said charging device and an area of said photosensitive member charged by said charging device which is supplied with a predetermined DC voltage with discharging by said pre-exposure means.

5. An apparatus according to claim 4, further comprising a setting device for setting a light projection condition of said pre-exposure means when a charging bias voltage is corrected by said correcting means such that the condition is substantially the same as a condition when said photosensitive member is discharged.

6. An apparatus according to claim 4, wherein a charging bias voltage is in the form of an AC voltage component biased by a DC voltage component, and said correcting means corrects the DC voltage component on the basis of the outputs of said current detector.

* * * * *